US011670840B2

(12) United States Patent
Fraysse et al.

(10) Patent No.: US 11,670,840 B2
(45) Date of Patent: Jun. 6, 2023

(54) TWO-DIMENSIONAL ANALOGUE MULTIBEAM FORMER OF REDUCED COMPLEXITY FOR RECONFIGURABLE ACTIVE ARRAY ANTENNAS

(71) Applicant: THALES, Courbevoie (FR)

(72) Inventors: Jean-Philippe Fraysse, Toulouse (FR); Hervé Legay, Plaisance du Touch (FR); Florian Vidal, Vendargues (FR)

(73) Assignee: THALES, Courbevoie (FR)

( * ) Notice: Subject to any disclaimer, the term of this patent is extended or adjusted under 35 U.S.C. 154(b) by 325 days.

(21) Appl. No.: 16/914,291

(22) Filed: Jun. 27, 2020

(65) Prior Publication Data

US 2020/0411971 A1 Dec. 31, 2020

(30) Foreign Application Priority Data

Jun. 27, 2019 (FR) ..... 1907001

(51) Int. Cl.
*H01Q 1/28* (2006.01)
*H01Q 21/06* (2006.01)
(Continued)

(52) U.S. Cl.
CPC ..... *H01Q 1/288* (2013.01); *H01Q 21/061* (2013.01); *H01Q 21/22* (2013.01); *H01Q 25/008* (2013.01)

(58) Field of Classification Search
CPC ..... H01Q 1/288; H01Q 21/061; H01Q 21/22; H01Q 25/008; H01Q 3/26; H01Q 3/38; H01Q 25/00; H01Q 3/40
See application file for complete search history.

(56) References Cited

U.S. PATENT DOCUMENTS 3,736,592 A * 5/1973 Coleman ..... H01Q 3/40 343/777
4,041,501 A * 8/1977 Frazita ..... H01Q 21/06 342/373

(Continued)

FOREIGN PATENT DOCUMENTS

EP 1 170 823 A1 1/2002
EP 3 176 875 A1 6/2017

OTHER PUBLICATIONS

Tugend et al., entitled "Hybrid beamforming with reduced grating lobes for satellite applications", EuCAP 2018.

*Primary Examiner* — Jinsong Hu
*Assistant Examiner* — Rui M Hu
(74) *Attorney, Agent, or Firm* — BakerHostetler

(57) ABSTRACT

A multibeam analogue former of several two-dimensional radiofrequency beams of continuously variable sizes and/or aiming directions for a reconfigurable two-dimensional active array antenna, includes a first set of analogue multibeam formers of fixed one-dimensional beams, of identical structure, superposed and connected at the output to rows of elementary radiating feeds of a planar antenna array in a first axial direction X. The analogue multibeam former comprises a second set of second one-dimensional analogue formers of radiofrequency beams that are continuously variable in size and/or in aiming direction in second angular aiming directions By along a second axial direction Y. Each second analogue former is formed by a divider with a single input and R output branches in transmission mode, each output branch of the divider including an amplitude and phase control point. Each second analogue former of the second set is connected to at least one access column of the first set of first analogue formers, an access column being (Continued)

formed by R access terminals to the input channels of the same rank j of the first analogue formers.

16 Claims, 25 Drawing Sheets

(51) Int. Cl.
*H01Q 21/22* (2006.01)
*H01Q 25/00* (2006.01)

(56) References Cited

U.S. PATENT DOCUMENTS 4,989,011 A * 1/1991 Rosen ..... H01Q 25/04 342/373
5,115,248 A * 5/1992 Roederer ..... H01Q 3/2658 342/368
5,548,295 A * 8/1996 Lo Forti ..... H01Q 3/40 342/373
5,714,957 A * 2/1998 Searle ..... H04W 16/28 342/373
5,734,349 A * 3/1998 Lenormand ..... H01Q 25/007 342/372
5,812,089 A * 9/1998 Locke ..... H01Q 25/00 342/373
5,936,588 A 8/1999 Rao et al.
6,218,987 B1 * 4/2001 Derneryd ..... H01Q 25/04 342/373
6,252,560 B1 * 6/2001 Tanaka ..... H01Q 25/00 342/371
6,340,948 B1 * 1/2002 Munoz-Garcia ..... H01Q 21/22 342/373
6,377,558 B1 * 4/2002 Dent ..... H04B 7/18515 370/347
6,992,622 B1 * 1/2006 Chiang ..... H01Q 25/02 342/373
8,344,945 B2 1/2013 Craig et al.
8,773,306 B2 * 7/2014 Milano ..... H01Q 1/246 342/368
9,595,766 B2 * 3/2017 Ashrafi ..... H01Q 15/0033
10,566,693 B2 * 2/2020 Tsai ..... H01Q 3/40
11,089,595 B1 * 8/2021 Frigon ..... H04W 72/046
11,245,442 B1 * 2/2022 Foo ..... H01Q 1/288
2002/0005800 A1 * 1/2002 Caille ..... H01Q 25/008 342/354
2002/0171585 A1 * 11/2002 Eiges ..... H01Q 25/00 342/361
2003/0038752 A1 * 2/2003 Park ..... H01Q 3/40 343/757
2004/0174299 A1 * 9/2004 Casas ..... H01Q 25/00 342/373
2005/0030227 A1 * 2/2005 Shamsaifar ..... H01Q 21/205 342/373
2011/0102263 A1 * 5/2011 Angeletti ..... H01Q 3/40 342/373
2014/0210666 A1 * 7/2014 Maltsev ..... H01Q 3/40 343/893
2014/0225777 A1 * 8/2014 Harel ..... H01Q 3/40 342/373
2014/0354499 A1 * 12/2014 Legay ..... H01Q 3/26 343/778
2017/0162943 A1 * 6/2017 Legay ..... H01Q 1/422
2018/0337453 A1 * 11/2018 Tsai ..... H01Q 3/40
2020/0303828 A1 * 9/2020 Urzhumov ..... H01Q 3/46
2020/0328787 A1 * 10/2020 Wang ..... H04B 7/0608
2020/0403310 A1 * 12/2020 Merola ..... H01Q 25/008
2021/0013916 A1 * 1/2021 Shimura ..... H01Q 3/2605
2021/0152238 A1 * 5/2021 Krause ..... H04B 7/2041
2021/0249782 A1 * 8/2021 Angeletti ..... H01Q 25/00
2021/0409087 A1 * 12/2021 Horn ..... H04B 7/0686
2022/0059950 A1 * 2/2022 Brown ..... H01Q 1/246

* cited by examiner

TWO-DIMENSIONAL ANALOGUE MULTIBEAM FORMER OF REDUCED COMPLEXITY FOR RECONFIGURABLE ACTIVE ARRAY ANTENNAS

CROSS-REFERENCE TO RELATED APPLICATIONS

This application claims priority to foreign French patent application No. FR 1907001, filed on Jun. 27, 2019, the disclosure of which is incorporated by reference in its entirety.

FIELD OF THE INVENTION

The present invention relates to a two-dimensional analogue multibeam former of reduced complexity for reconfigurable two-dimensional active array antennas.

The invention relates also to a reconfigurable two-dimensional active multibeam antenna of reduced complexity in transmission and/or reception mode using a two-dimensional analogue multibeam former of reduced complexity according to the invention.

The invention relates also to a satellite payload of a telecommunications satellite comprising a multibeam reception antenna and/or a multibeam transmission antenna, interconnected by a router, and in which the multibeam reception antenna and/or the multibeam transmission antenna are reconfigurable two-dimensional active multibeam antennas of reduced complexity according to the invention.

BACKGROUND

Reconfigurable active array antennas are known for generating, with a single array of radiating elements or radiating feeds, several reconfigurable beams which can be adapted to changes over time of a need for spatial distribution of transmission traffic.

These antennas are particularly suited to satellite applications which require a capacity or ability to reconfigure, as a function of time, the coverage of the beams generated by the antenna. This requirement to be able to reconfigure the geographic coverage of the beams as a function of time is significant for a large number of satellite applications such as telecoms satellites for geostationary, medium earth or low earth orbits alike.

Thus, for example, for the constellations of satellites in low or medium earth orbits, such antennas make it possible to adapt the coverage of each satellite to the changing need induced by the movement of the satellite relative to the earth and are therefore highly attractive.

However, given the large number of satellites in these constellations, these antennas must not only be reconfigurable but must also satisfy the requirement of reduced cost of these systems, which can be translated technically into a reduction of the complexity and/or of the processing.

Furthermore, the limited power resources of the satellite systems also require the power consumed by such antennas to be minimized. It is known that one of the main elements of these antennas affecting the abovementioned criteria is the beam former.

Different architectures are known for producing reconfigurable two-dimensional 2D beam formers and can be grouped together in two families according to the level or degree of their ability to reconfigure the coverage of the beams, this level being hereinafter called "level of reconfigurability". A first family groups together the multibeam formers that have a "total" level of reconfigurability and a second family groups together the multibeam formers that have a "partial" level of reconfigurability. Obviously, the total reconfigurability of a two-dimensional active array antenna is obtained by relying on beam formers that are more complex than those which allow for a partial reconfigurability.

In the case of beam formers with total reconfigurability, the beam forming in digital mode means having a digitized access associated with each active radiating element via digital-analogue conversion interfaces. These interfaces are costly and energy-intensive, and all the more so when the operating frequencies are high. In the case of the Ka band satellite applications, this consumption is increased by the need to add a frequency conversion stage to remain within the range of operations that can be accessed by the digital-analogue converters. It is therefore important to minimize the number of digitized accesses if the criteria of reduced complexity and reduced consumed power are predominant in the design of a payload. Thus, the integration of beam formers in the digital part of the satellite payloads very substantially increases the complexity and consumption when the number of radiating elements is greater than the number of beams to be routed.

In the case of beam formers with total reconfigurability, the analogue mobile beam formers constitute a very attractive alternative to the digital beam formers when the criteria of limited complexity and consumed power have to be prioritized. However, these analogue mobile beam formers are disadvantaged by the difficulty in implementing this solution when the numbers of radiating elements and of beams are high. Thus, by way of example, the generation of 20 beams from 500 radiating elements means having to implement, in the analogue beam former, 20 1-to-500 dividers, 10 000 amplitude/phase control points and 500 20-to-1 combiners. It is stipulated that each amplitude/phase control point incorporates phase-shifters or variable delay lines and can also incorporate variable attenuators or amplifiers. The physical implementation of these elements comes up against not only their great number but also the complexity of the routings to be set up between these different elements and the difficulty in controlling the phase dispersions of this multitude of radiofrequency paths. That is all the more true when the operating frequency is high.

In the case of beam formers with partial reconfigurability, a first solution consists in implementing fixed beam formers associated with a beam selection device. The fixed beam formers can be produced using Butler or Blass matrices, quasi-optical formers such as Rotman lenses or continuous delay lenses, or hybrid devices combining different types of fixed beam formers. Among the various types of fixed beam formers, the quasi-optical beam formers are particularly interesting because they make it possible, with a single element, to simultaneously produce several beams from several radiating element accesses, and thus constitute an alternative to the complexity of the variable phase analogue beam formers. As is known, one-dimensional Rotman or continuous delay lenses form beams distributed over a single axis. To form beams distributed over two axes with one-dimensional quasi-optical beam formers with one distribution axis, it is then necessary to connect two different sets of quasi-optical beam formers, as described for example in a first document, formed by the U.S. Pat. No. 5,936,588 by S. K. Rao et al., entitled "Reconfigurable multiple beam satellite phased array antenna". According to this first document, the two sets are composed of quasi-optical beam formers that are superposed and positioned at right angles to one another. The main drawback with such an architecture is that the number of accesses of the two-dimensional 2D beam former on the beam side is significantly higher than the number of beams when the beam former has to address a wide coverage with narrow beams. Consequently, to minimize the number of digital-analogue converters of the payload, it is then necessary to place, upstream of the beam former, a selection matrix that makes it possible to reduce the number of accesses processed by the digital part. This selection matrix is complex to produce in the case of a large number of accesses of the two-dimensional quasi-optical beam former. Another drawback with this architecture is the significant bulk resulting from the series arrangement of the two groups of quasi-optical formers and of the selection matrix. Furthermore, such an architecture leads to a discretization of the coverage in which a beam is moved by jumps between preformed beams.

In the case of beam formers with partial reconfigurability, a second solution consists in implementing the association of subsets of two-dimensional beam formers and one final two-dimensional beam former.

A second document, by Vincent Tugend et al., entitled "Hybrid beamforming with reduced grating lobes for satellite applications" and published in EuCAP 2018, describes different types of associations of the second solution including:

the association of subsets of analogue beam formers which overlap and one main digital beam former;

the association of subsets of quasi-optical beam formers which overlap and one main digital beam former;

the association of subsets of quasi-optical formers which overlap, of switches and of one main digital beam former.

The patent application U.S. Pat. No. 8,344,945, with the title "System for simplification of reconfigurable beamforming network processing within a phased array antenna for a telecommunications satellite", and forming a third document, describes another type of association of the second solution in which there are associated subsets of overlapping analogue beam formers and one main analogue beam former.

The approach presented in the second and third documents makes it possible to reduce the number of control points of the beam formers by dividing the beam former into two parts, a first part composed of beam formers from subarrays of radiating elements and a second part comprising one main beam former. The first drawback of this approach is the generation of array lobes that are detrimental to the performance of the antenna and which can certainly be attenuated but at the cost of the use of several levels of amplifiers and an increase in the control points with an overlapping of the subarrays. The second drawback of this approach is the generation of beams that are grouped together and it does not make it possible, at the same time, to generate beams that are dispersed over all the coverage of the antenna.

None of the embodiments of the beam formers makes it possible to generate, from a large number of radiating elements of a predetermined two-dimensional antenna array, the high number of beam configurations that are reconfigurable in terms of aiming angles and/or sizes, that can be dispersed, at one and the same moment, over all the coverage of the antenna, and at another moment, grouped together in a limited compact zone of said coverage of the antenna, consuming low electrical power and using a reduced number of amplitude/phase control points.

A first technical problem is how to provide a beam former the architecture of which makes it possible to generate, from a large number of radiating elements of a predetermined two-dimensional antenna array, a high number of beam configurations that are reconfigurable in terms of aiming angles and/or of sizes, that can be dispersed, at one and the same moment, over all the coverage of the antenna, and at another moment, grouped together in a limited compact zone of said coverage of the antenna, consuming low electrical power and using a reduced number of amplitude/phase control points.

A second technical problem is how to provide an analogue beam former which resolves the first technical problem and in which a limited number of amplitude/phase control points is used to fulfil the requirements of flexibility and of speed of reconfigurability of the beams of the antenna.

SUMMARY OF THE INVENTION

To this end, the subject of the invention is a two-dimensional analogue multibeam former of several two-dimensional radiofrequency beams of continuously variable sizes and/or aiming directions for a reconfigurable two-dimensional active array antenna, having a total integer number M, greater than or equal to 4, of radiating feeds distributed over a planar or curved surface according to a mesh formed by the points of intersection of a first array of a first integer number R, greater than or equal to 2, of parallel lines in a first axial direction X, and of a second array of a second integer number S, greater than or equal to 2, of parallel lines in a second axial direction Y, different from the first axial direction X.

The analogue multibeam former comprises a first set in which there are superposed R first analogue formers of identical structure and configured to form P fixed radiofrequency beams in first annular aiming directions Ax fixed along the first axial direction X, each first analogue former, i varying from 1 to R, being configured to be connected through S output channels in transmission mode or S input channels in reception mode, corresponding to a row of S radiating feeds of the antenna array and corresponding to a different line of the mesh of the antenna array, identified by a level index i, i varying from 1 to R; and each first analogue former having an integer number P, greater than or equal to 2, of input channels in transmission mode or of output channels in reception mode, numbered by an index of progression j along the first axial direction X.

The analogue multibeam former is characterized in that it comprises a second set of an integer number Q of second analogue formers of radiofrequency beams that are continuously variable in size and/or in aiming direction in second angular aiming directions By along the second axial direction Y, each second analogue former being formed by a divider with a single input and R output branches in transmission mode or by a combiner with a single output and R input branches in reception mode, each output branch of a divider in transmission mode or input branch of a combiner in reception mode including an amplitude and phase control point; each second analogue former of the second set being connected to at least one access column of the first set of first beam formers, an access column being formed by R access terminals to the input channels of the same rank j of the first analogue formers.

According to particular embodiments, the two-dimensional analogue multibeam former comprises one or more of the following features, taken alone or in combination:

the first analogue formers are superposed along the second axial direction Y and each correspond to a different row of radiating feeds along the first axial direction X; and the second analogue formers are aligned side-by-side along the first axial direction X and each correspond to one or more adjacent access columns to the second analogue formers of the second set;

the R superposed first analogue formers of the first set are quasi-optical formers or Butler matrices;

the amplitude and phase control points of the R output branches in transmission mode or R input branches in reception mode of each of the Q second analogue formers, aligned side-by-side, of the second set are analogue electrical components for phase-shifting and amplification or attenuation with phase-shifting and gain that are continuously or quasi-continuously variable as a function of analogue commands or of discrete commands with fine resolution over a wide range;

the two-dimensional analogue multibeam former also comprises, for each first analogue former and the associated level i, i varying from 1 to R, a combiner in transmission mode according to a predetermined configuration of combination or a divider in reception mode according to a predetermined configuration of division, of the outputs in transmission mode or of the inputs in reception mode of the second analogue formers having the associated level i of the first analogue former of fixed beams in the first angular direction;

the two-dimensional analogue multibeam former also comprises, for each first analogue former and the associated level i, i varying from 1 to R, inside the two-dimensional analogue multibeam former, a first switching matrix, according to a first configuration of a predetermined set of routings, for the outputs in transmission mode or the inputs in reception mode of the second analogue formers having the same associated level i of the first analogue former of fixed beams in the first angular direction X;

the two-dimensional analogue multibeam former also comprises, peripheral to the two-dimensional analogue multibeam former and opposite the access channels to the radiating feeds of the antenna array, a second switching matrix, according to a second configuration of a predetermined set of routings, for switching the Q inputs in transmission mode or the Q outputs in reception mode of the second analogue formers to an integer number T, greater than or equal to 2 and less than or equal to Q, of beam inputs in transmission mode or of beam outputs in reception mode;

the analogue multibeam former also comprises, for each first analogue former and the associated level i, i varying from 1 to R, inside the two-dimensional analogue multibeam former, a first switching matrix, according to a first configuration of a predetermined set of routings, for the outputs in transmission mode or the inputs in reception mode of the second analogue formers having the associated level of said first analogue former of fixed beams in the first angular direction; and, peripheral to the two-dimensional analogue multibeam former and opposite the access channels to the radiating feeds of the antenna, a second switching matrix, according to a second configuration of a predetermined set of routings, for switching the Q inputs in transmission mode or the Q outputs in reception mode of the second analogue formers to an integer number T, greater than or equal to 2 and less than or equal to Q, of beam inputs in transmission mode or of beam outputs in reception mode;

the number P of input channels in transmission mode or of output channels in reception mode of each first analogue former is strictly greater than the first number R of input channels in transmission mode or of output channels in reception mode of the radiating feeds of one and the same row in the first axial direction; and the two-dimensional analogue multibeam former comprises, for each first analogue former and the associated level, a divider in transmission mode according to a predetermined configuration of division or a combiner in reception mode according to a predetermined configuration of combination, of the outputs in transmission mode or of the inputs in reception mode of the second analogue formers having the associated level of the first analogue former of fixed beams in the first angular direction, the divider in transmission mode or the combiner in reception mode being connected between the outputs in transmission mode or the inputs in reception mode of the second analogue formers having the associated level of said first analogue former of fixed beams in the first angular direction, and the inputs in transmission mode or the outputs in reception mode of the first analogue former;

the two-dimensional analogue multibeam former also comprises, for each first one-dimensional analogue beam former and the associated level i, i varying from 1 to R, in transmission mode, connected to the inputs of said first analogue former of fixed beams, a divider according to a configuration of division of the outputs of the second beam formers forming beams having the associated level i of said first analogue former of fixed beams, or in reception mode, connected to the outputs of said first analogue beam former, a combiner according to a configuration of combination of the inputs of the second analogue beam formers forming beams having the associated level j of said first analogue former of fixed beams; and, in transmission mode, the configuration of division is a function of a predetermined pattern of the widths of the transmission beams in the first angular direction Ax; or, in reception mode, the configuration of combination is a function of a predetermined pattern of the widths of the reception beams in the second angular direction Ax;

in transmission mode, the amplitude and phase control points of the second formers of beams that are continuously variable in size are adjusted so that the radiation patterns of the transmission beams generated according to predetermined aimings exhibit iso-flux radiation patterns; or, in reception mode, the amplitude and phase control points of the second formers of beams that are continuously variable in size are adjusted so that the radiation patterns of the reception beams generated according to predetermined aimings exhibit iso-flux radiation patterns;

the second analogue formers of mobile beams of the second set are integrated in a single circuit of planar form, the integrated circuit being disposed in a plane at right angles to the planes of extension of the circuits of the first analogue formers of fixed beams and endwise abutting with the edges of said circuits, parallel to one another and contained in one and the same plane.

The subject of the invention is a two-dimensional analogue multibeam former of several two-dimensional radiofrequency beams of continuously variable sizes and/or aiming directions for a reconfigurable two-dimensional active array antenna having a total integer number M, greater than or equal to 4, of radiating feeds, forming an antenna array and distributed over a compact and single-piece portion D of a planar or curved surface according to a compact stack of an integer number R, greater than or equal to 2, of rows r(i) that are parallel to one another and oriented in a first local axial direction X, the stack being oriented in a second axial direction Y, different from the first local axial direction X, i designating a level and numbering index from 1 to R in the direction of progression of the second axial direction Y of stacking of said rows r(i), each row r(i), i varying from 1 to R, having an integer number S(i) that is a function of the level i of radiating feeds, the sum of the integers S(i) i varying from 1 to R, being equal to the number M.

The two-dimensional analogue multibeam former comprises a first set in which there are superposed R first analogue formers of identical structure and configured to form a number P, greater than or equal to 2, of fixed radiofrequency beams in first angular aiming directions Ax that are fixed along the first local axial direction X, each first analogue former i, i varying from 1 to R, being configured to be connected through the integer number S(i) of output channels in transmission mode or S(i) input channels in reception mode, corresponding to the row r(i) of the S(i) radiating feeds of the antenna array; and each first analogue former having P input channels in transmission mode or output channels in reception mode, numbered by an index of progression j along the first axial direction X.

The two-dimensional analogue multibeam former is characterized in that it comprises a second set of an integer number Q of second analogue formers of radiofrequency beams that are continuously variable in size and/or in aiming direction in second angular aiming directions By along the second axial direction Y, each second analogue former being formed by a divider with a single input and R output branches in transmission mode or by a combiner with a single output and R input branches in reception mode, each output branch of a divider in transmission mode or input branch of a combiner in reception mode including an amplitude and phase control point; each second analogue former of the second set being connected to at least one access column of the first set of first beam formers, an access column being formed by R access terminals to the input channels of the same rank of the first analogue formers.

Another subject of the invention is a reconfigurable two-dimensional active transmission antenna for transmitting radiofrequency signals on a plurality of transmission beams of continuously variable sizes and/or aiming directions, comprising an antenna array of radiating feeds, a set of HP RF power amplifiers, and a two-dimensional analogue multibeam former.

The antenna array of radiating feeds has a total integer number M, greater than or equal to 4, of radiating feeds distributed over a planar or curved surface according to a mesh formed by the points of intersection of a first array of a first integer number R, greater than or equal to 2, of parallel lines in a first axial direction X, and of a second array of a second integer number S, greater than or equal to 2, of parallel lines in a second axial direction Y, different from the first axial direction X.

The two-dimensional analogue multibeam former comprises a first set in which there are superposed R first analogue formers of identical structure and configured to form P fixed radiofrequency transmission beams in first angular aiming directions Ax that are fixed along the first axial direction X, each first analogue former being configured to be connected through S output channels in transmission mode, corresponding to a row of S radiating feeds of the antenna array and corresponding to a different line of the mesh of the antenna, identified by a level index i, i varying from 1 to R; and each first analogue former having an integer number P, greater than or equal to 2, of input channels in transmission mode, numbered by an index of progression j along the first axial direction X.

The two-dimensional active multibeam transmission antenna is characterized in that the analogue multibeam former comprises a second set of an integer number Q, greater than or equal to 2, of second analogue formers of radiofrequency beams that are continuously variable in size and/or in aiming direction in second angular aiming directions By along the second axial direction Y, each second analogue former being formed by a divider with a single input and R output branches in transmission mode, each output branch of a divider including an amplitude and phase control point; each second analogue former of the second set being connected to at least one access column of the first set of first beam formers, an access column being formed by R access terminals to the input channels of the same rank j of the first analogue formers.

Another subject of the invention is a reconfigurable two-dimensional active reception antenna for receiving radiofrequency signals over a plurality of reception beams of continuously variable sizes and/or aiming directions, comprising an antenna array of radiating feeds, a set of low-noise RF amplifiers (LNA), and a two-dimensional analogue multibeam former.

The antenna array of radiating feeds has a total integer number M, greater than or equal to 4, of radiating feeds distributed over a planar or curved surface according to a mesh formed by the points of intersection of a first array of a first integer number R, greater than or equal to 2, of parallel lines in a first axial direction X, and of a second array of a second integer number S, greater than or equal to 2, of parallel lines in a second axial direction Y, different from the first axial direction X.

The two-dimensional analogue multibeam former comprises a first set in which there are superposed S first analogue formers of identical structure and configured to form R fixed radiofrequency beams in first angular aiming directions Ax along the first axial direction X, each first analogue former being configured to be connected through S input channels in reception mode, corresponding to a row of S radiating feeds of the antenna array and corresponding to a different line of the mesh of the antenna, identified by a level index i, i varying from 1 to R; and each first analogue former having an integer number P, greater than or equal to 2, of output channels in reception mode, numbered by an index of progression j along the first axial direction X.

The two-dimensional active transmission antenna is characterized in that the analogue multibeam former comprises a second set of an integer number Q of second analogue formers of radiofrequency beams that are continuously variable in size and/or in aiming direction in second angular aiming directions By along the second axial direction Y, each second analogue former being formed by a combiner with a single output and R input branches in reception mode, each input branch of a combiner including an amplitude and phase control point; each second analogue former of the second set being connected to at least one access column of the first set, an access column being formed by R access terminals to the output channels of the same rank i of the first analogue formers.

Another subject of the invention is a reconfigurable two-dimensional active transmission antenna for transmitting radiofrequency signals over a plurality of transmission beams of continuously variable sizes and/or aiming directions, comprising an antenna array of radiating feeds, a set of HP RF power amplifiers, and a two-dimensional analogue multibeam former.

The antenna array of radiating feeds has a total integer number M, greater than or equal to 4, of radiating feeds distributed over a compact and single-piece portion D of a planar or curved surface according to a compact stack of an integer number R, greater than or equal to 2, of rows r(i) that are parallel to one another and oriented in a first local axial direction X, the stack being oriented in a second axial direction Y, different from the first local axial direction X, i designating a level and numbering index from 1 to R in the direction of progression of the second axial direction Y of stacking of said rows r(i), each row r(i), i varying from 1 to R, having an integer number S(i) that is a function of the level i of radiating feeds, the sum of the integers S(i), i varying from 1 to R, being equal to the number M.

The two-dimensional analogue multibeam former comprises a first set in which there are superposed R first analogue formers of identical structure and configured to form a number P, greater than or equal to 2, of fixed radiofrequency transmission beams in first angular aiming directions Ax that are fixed along the first local axial direction X, each first analogue former of level i, i varying from 1 to R, being configured to be connected through the integer number S(i) of output channels in transmission mode, corresponding to the row r(i) of the S(i) radiating feeds of the antenna array; and each first analogue former having P input channels in transmission mode, numbered by an index of progression j along the first axial direction X.

The two-dimensional active transmission antenna is characterized in that the analogue multibeam former comprises a second set of an integer number Q of second analogue formers of radiofrequency beams that are continuously variable in size and/or in aiming direction in second angular aiming directions By along the second axial direction Y, each second analogue former being formed by a divider with a single input and R output branches in transmission mode, each output branch of a divider in transmission mode including an amplitude and phase control point; each second analogue former of the second set being connected to at least one access column of the first set of first beam formers, an access column being formed by R access terminals to the input channels of the same rank of the first analogue formers.

Another subject of the invention is a reconfigurable two-dimensional active reception antenna for receiving radiofrequency signals over a plurality of reception beams of continuously variable sizes and/or aiming directions, comprising an antenna array of radiating feeds, a set of low-noise RF amplifiers (LNA), and a two-dimensional analogue multibeam former.

The antenna array of radiating feeds has a total integer number M, greater than or equal to 4, of radiating feeds distributed over a compact and single-piece portion D of a planar or curved surface according to a compact stack of an integer number R, greater than or equal to 2, of rows r(i) that are parallel to one another and oriented in a first local axial direction X, the stack being oriented in a second axial direction Y, different from the first local axial direction X, i designating a level and numbering index from 1 to R in the direction of progression of the second axial direction Y of stacking of said rows r(i), each row r(i), i varying from 1 to R, having an integer number S(i) that is a function of the level i of radiating feeds, the sum of the integers S(i), i varying from 1 to R, being equal to the number M.

The two-dimensional analogue multibeam former comprises a first set in which there are superposed R first analogue formers of identical structure and configured to form a number P, greater than or equal to 2, of fixed radiofrequency reception beams in first angular aiming directions Ax that are fixed along the first local axial direction X, each first analogue former of level i, i varying from 1 to R, being configured to be connected through the integer number S(i) of input channels in reception mode, corresponding to the row r(i) of the S(i) radiating feeds of the antenna array; and each first analogue former having P output channels in reception mode, numbered by an index of progression j along the first axial direction X.

The two-dimensional active reception antenna is characterized in that the analogue multibeam former comprises a second set of an integer number Q of second analogue formers of radiofrequency beams that are continuously variable in size and/or in aiming direction in second angular aiming directions By along the second axial direction Y, each second analogue former being formed by a combiner with a single output and R input branches in reception mode, each input branch of a combiner in reception mode including an amplitude and phase control point; each second analogue former of the second set being connected to at least one access column of the first set of first beam formers, an access column being formed by R access terminals to the output channels in reception mode of the same rank j of the first analogue formers.

Another subject of the invention is a satellite payload of a telecommunications satellite comprising a multibeam reception antenna, a multibeam transmission antenna, and a router interconnecting the multibeam reception antenna and the multibeam transmission antenna, the multibeam transmission antenna being defined as described above and/or the multibeam reception antenna being defined as above.

According to particular embodiments, the satellite payload comprises one or more of the following features, taken alone or in combination:

the router is a digital transparent processor (DTP).

BRIEF DESCRIPTION OF THE DRAWINGS

The invention will be better understood on reading the following description of several embodiments, given purely by way of example and with reference to the drawings, in which.

DETAILED DESCRIPTION

Figure 1:
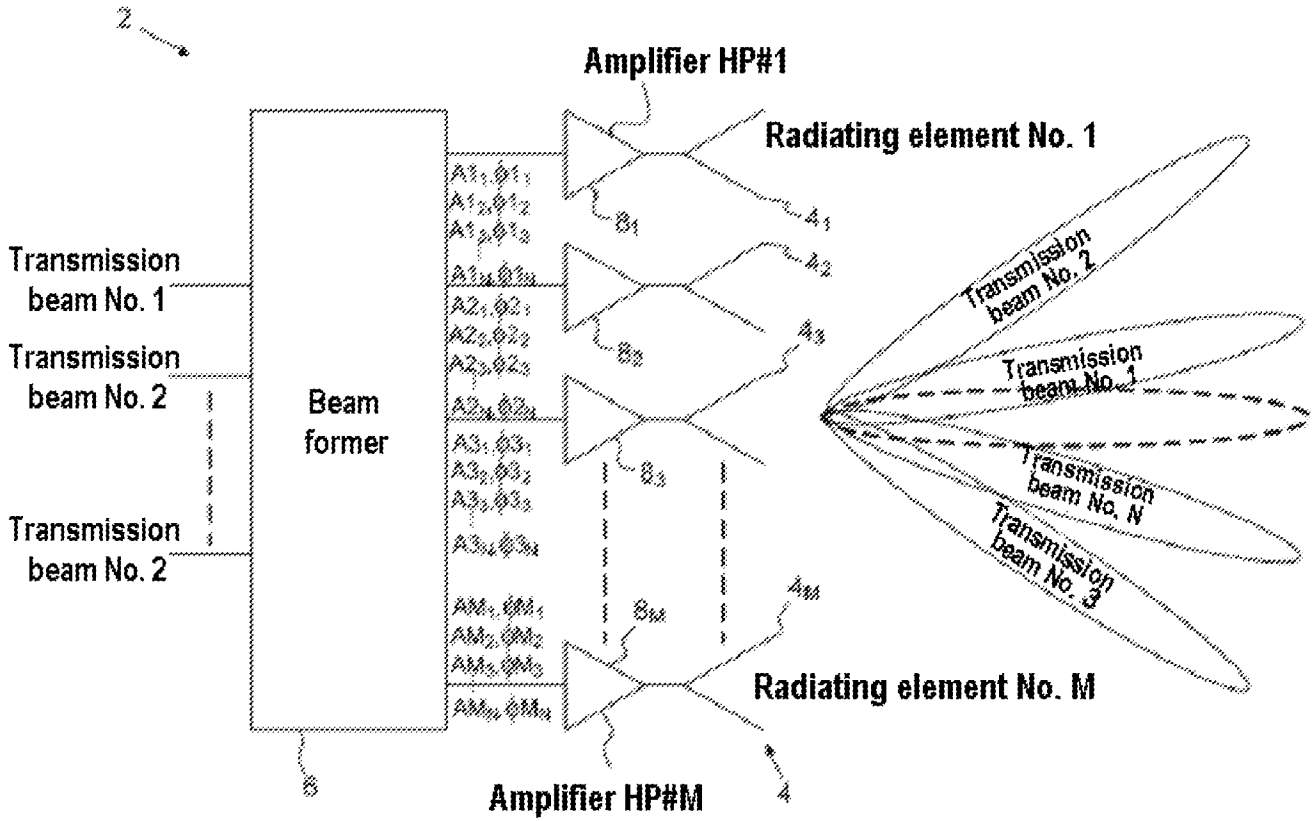
FIG. 1 is an overview of a two-dimensional 2D active antenna in transmission mode according to the invention.

According to FIG. 1, an active array antenna 2 according to the invention is formed by an antenna array 4 of a number M of active radiating elements or of active elementary radiating feeds $\mathbf{4}_1$, $\mathbf{4}_2$, $\mathbf{4}_3$, . . . , $\mathbf{4}_M$, associated with an analogue former 6 of reconfigurable beams according to the invention generating a number N of beams.

Here, the active array antenna 2 is configured in transmission mode and comprises M radiofrequency RF power amplifiers HPA $\mathbf{8}_1$, $\mathbf{8}_2$, $\mathbf{8}_3$, . . . , $\mathbf{8}_M$, connected between the analogue beam former 6 and the M elementary radiating feeds $\mathbf{4}_1$, $\mathbf{4}_2$, $\mathbf{4}_3$, . . . , $\mathbf{4}_M$.

Depending on the number of axes needed to identify the positioning of the beams generated, the analogue beam former is called one-dimensional or two-dimensional (1D or 2D) analogue beam former.

According to the invention, the analogue beam former is a two-dimensional 2D analogue beam former.

The term "active" indicates that each radiating feed has an associated amplifier, here a power amplifier HPA for the antenna in transmission mode. This proximity between the amplifiers and the radiating feeds makes it possible to minimize the loses between these two types of device and thus maximize the overall RF performance of the antenna system.

The analogue beam former makes it possible to create, for each beam to be generated, the phase and amplitude law (A, $\phi$) to be applied to the radiating feeds of the antenna array.

The modification of the phase and amplitude law of a beam makes it possible to reconfigure the characteristics of this beam in terms of aiming direction, width of the beam or other beam form parameters.

Figure 2:
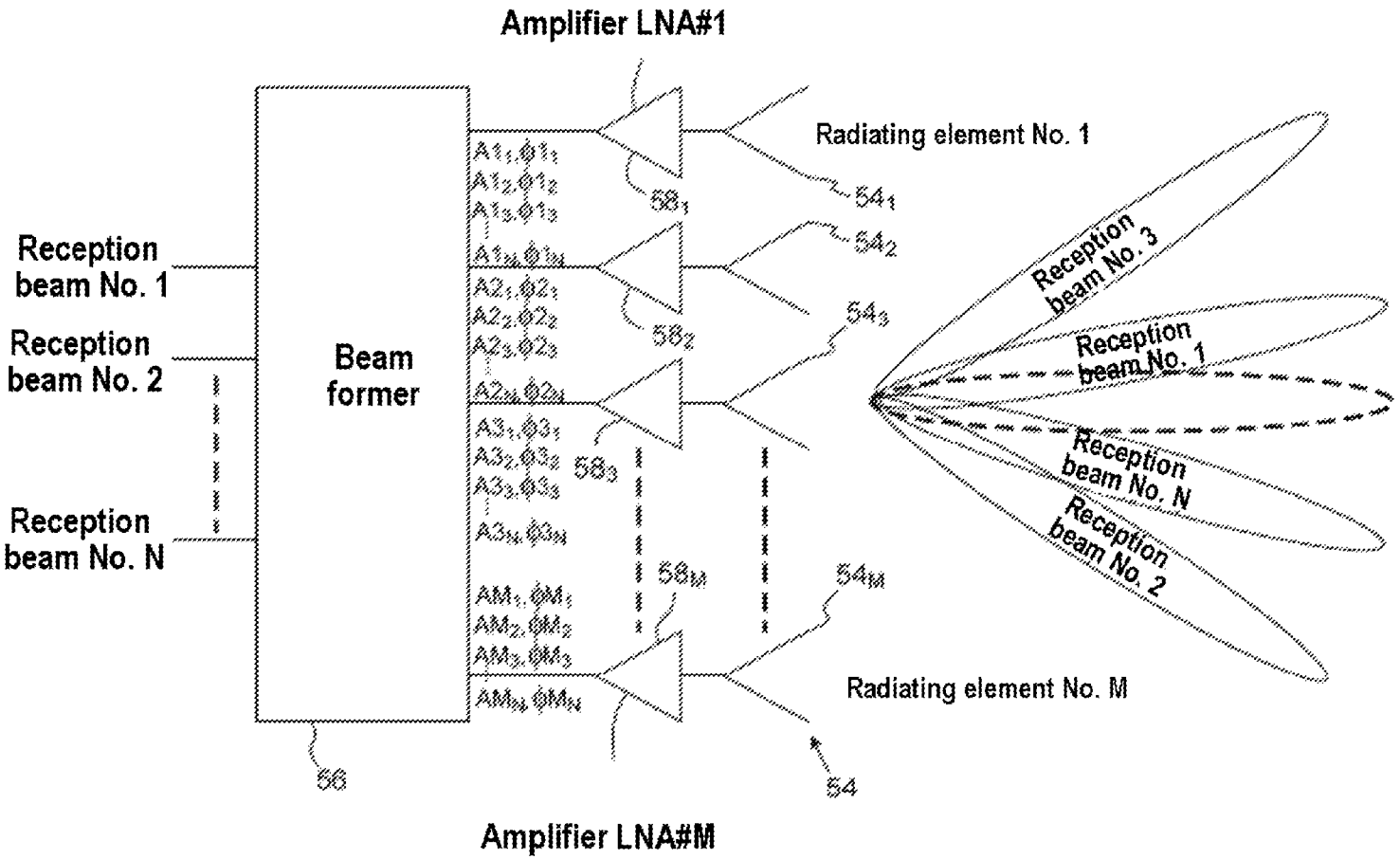
FIG. 2 is an overview of a two-dimensional 2D active antenna in reception mode according to the invention.

According to FIG. 2 and the invention, an active array antenna 52, here in reception mode, comprises an antenna array 54 formed by a predetermined number M of active elementary radiating feeds $\mathbf{54}_1$, $\mathbf{54}_2$, $\mathbf{54}_3$, . . . , $\mathbf{54}_M$, associated with an analogue beam former 56 according to the invention generating a number N of reception beams.

The active array antenna 52 comprises M radiofrequency RF amplifiers $\mathbf{58}_1$, $\mathbf{58}_2$, $\mathbf{58}_3$, . . . , $\mathbf{58}_M$, connected between the M elementary radiating feeds $\mathbf{54}_1$, $\mathbf{54}_2$, $\mathbf{54}_3$, . . . , $\mathbf{54}_M$, and the analogue multibeam former, which, unlike the power amplifiers HPA of the transmission antenna of FIG. 1, are low-noise radiofrequency RF amplifiers LNA.

Like the active transmission array antenna 2 of FIG. 1, the analogue beam former 56 makes it possible to create, for each reception beam to be generated, the phase and amplitude law (A, $\phi$) to be applied to the radiating feeds of the antenna array.

The modification of the phase and amplitude law of a reception beam makes it possible to reconfigure the characteristics of this beam in terms of aiming direction, width of the beam or other beam form parameters.

Generally, analogue beam formers with two dimensions and with limited complexity for reconfigurable active array antennas according to the invention are based on an architecture associating one-dimensional analogue formers of fixed beams in a first angular direction with one-dimensional analogue formers of mobile beams in a second angular direction that is different from the first angular direction.

The limited complexity of the two-dimensional analogue beam formers is obtained by a dimensioning of the flexibility of the beam former to what is strictly needed. A total flexibility is pointless when the antenna is connected to a digital processor, managing multiple beams in parallel. The coverage zone of each of the beam accesses can be limited, and the complexity of the associated former can thus be reduced. The total coverage is then the concatenation of the coverages associated with each beam. To make it possible to address spatially concentrated user traffic, an overlapping of the individual coverages of each beam is allowed.

Moreover, it should be noted that the minimum ratio required between the useful signals and the interference signals (C/I) limits the proximity between two simultaneously active beams and induces an aiming restriction relative to each beam, even if each beam had total flexibility.

Thus, excessively strong proximities between the beams cause levels of interference to be induced between the beams which do not make it possible to use all the configurations. It follows therefrom that the inclusion of the C/I constraints in the dimensioning of the beam formers to best meet the needs of the users of satellites reveals that architectures with reduced flexibility can make it possible to achieve levels of satisfaction of the needs of the clients that are equivalent to those obtained with totally reconfigurable beam formers. Thus, simulations based on the architectures of beam formers according to the invention show that, despite a reduction by approximately a factor of 10 in the number of control points, these architectures make it possible to achieve a level of satisfaction of the need of the users that is equivalent to that with totally reconfigurable architectures for low earth orbit satellite applications.

In particular, the one-dimensional analogue formers of fixed beams can be quasi-optical beam formers.

In particular, the reconfigurable active array antennas according to the invention suit and are used for satellite applications.

Figure 3:
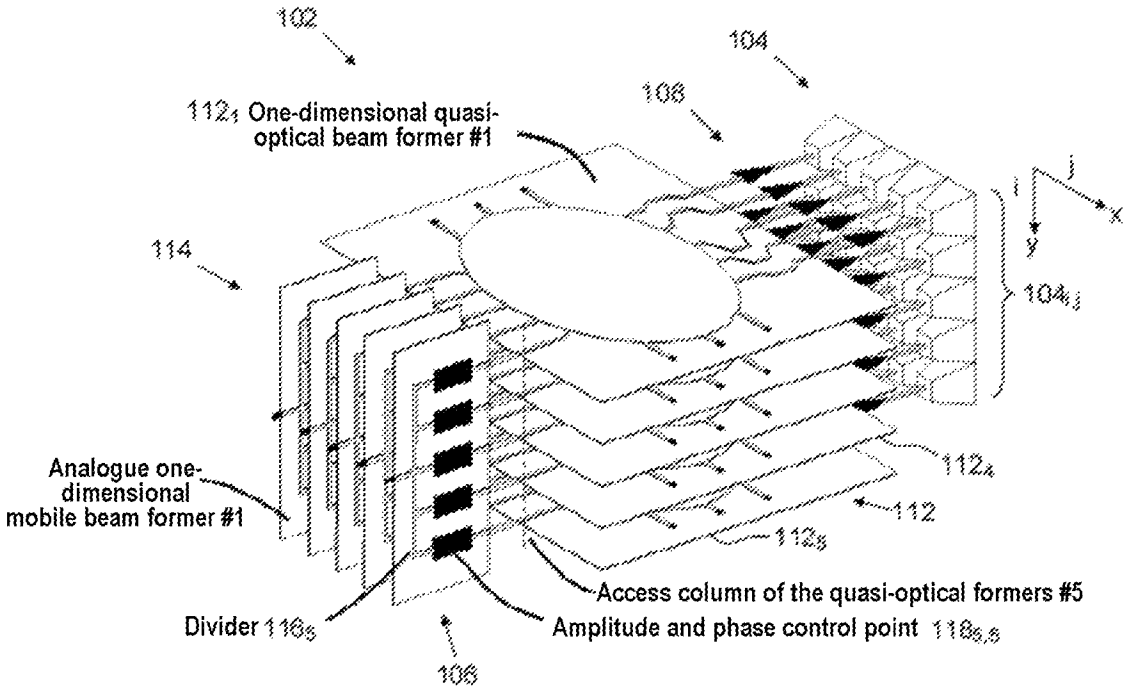
FIG. 3 is a perspective view of a first embodiment of an active transmission antenna according to the invention including its associated reconfigurable analogue multibeam former.

According to FIG. 3 and a first embodiment, a two-dimensional active array antenna 102, here configured in transmission mode, comprises an antenna array 104 of elementary radiating feeds $\mathbf{104}_{i,j}$, an analogue multibeam former 106 according to the invention of several two-dimensional radiofrequency transmission beams of continuously variable sizes and/or aiming directions, and a set 108 power amplifiers HPA $\mathbf{108}_{i,j}$ interconnecting the analogue multibeam former 106 of transmission beams to the elementary radiating feeds $\mathbf{104}_{i,j}$.

The antenna array 104 comprises a total integer number N, greater than or equal to 4, of elementary radiating feeds distributed over a planar surface according to a mesh or network formed by the points of intersection of a first series of a first integer number R, greater than or equal to 2, of parallel lines in a first axial direction X, numbered by an index i varying from 1 to R from top to bottom in the figure, and a second series of a second integer number S, greater than or equal to 2, of parallel lines in a second axial direction Y, different from the first axial direction X, numbered by an index j varying from 1 to S from left to right in FIG. 3.

Here, in particular and by way of example, the total number N of radiating feeds $\mathbf{104}_{i,j}$, the number R of first lines oriented in the first axial direction X and the number S of second lines oriented in the second axial direction Y are respectively equal to 25, 5 and 5.

The analogue multibeam former 106 of the transmission beams comprises a first set 112 of R first analogue formers 112*i*, *i* varying from 1 to R, superposed and having an identical structure, and configured to form S fixed radiofrequency RF beams in first angular aiming directions Ax along the first axial direction X.

Each first analogue former 112*i*, *i* varying from 1 to R, is configured to be connected through S output channels in transmission mode, corresponding to a row of S radiating feeds of the antenna array and corresponding to a line i of the first series of the mesh of the antenna, identified by the level index i, i being an integer varying from 1 to R.

Each first analogue former 112*i* comprises an integer number P, greater than or equal to 2, of input channels in transmission mode, numbered by an index of progression j along the first axial direction X, j varying from 1 to P.

The analogue multibeam former 106 of transmission beams also comprises a second set 114 of an integer number Q of second analogue formers $\mathbf{114}_k$ of radiofrequency beams that are continuously variable in size and/or in aiming direction in second angular aiming directions By along the second axial direction Y.

Each second analogue former 114*k*, k varying from 1 to Q, is formed by a divider 116*k* with a single input and R output branches in transmission mode, each output branch of a divider 116*k* including an amplitude and phase control point $\mathbf{118}_{k,i}$.

Each second analogue former 114*k* of the second set 114 is connected to an access column 118*k* of the first set, an access column 118*k* being formed by R access terminals to the input channels of the same rank j of the first analogue formers 112*i*.

Here, in particular and by way of example, the number P of input channels of each first analogue former is equal to S, that is to say 5, and the number Q of second analogue formers of radiofrequency beams that are continuously variable in size and/or in aiming direction is equal to S, that is to say 5.

Here, the five (R=5) first analogue formers 112*i* of fixed beams are quasi-optical beam formers, grouped together in the first set 112, and placed on the side of the radiating elements $\mathbf{104}_{i,j}$. The architecture of the analogue multibeam former 106 is illustrated here for a limited number of radiating elements in the interests of clarity, and it is all the more interesting and advantageous when the number of radiating elements is high.

The association of a first set 112 of first fixed quasi-optical beam formers and a second set 114 of second analogue formers of continuously variable transmission beams according to the two-dimensional arrangement described above allows for:

an easy implementation of the two-dimensional mobile beam former by virtue of the simplification provided by the use of the quasi-optical beam formers, connected at the input of the radiating feeds through the power amplifiers HPA;

the replacement of the conventional association of a connection matrix and a set of quasi-optical beam formers by a single set of analogue formers, which has the effect of simplifying and compacting the overall structure of the beam former;

the possibility of obtaining a reduced number of beam accesses to be processed ultimately by the payload;

the minimization of the power consumption and reduction of manufacturing complexity.

Figure 4:
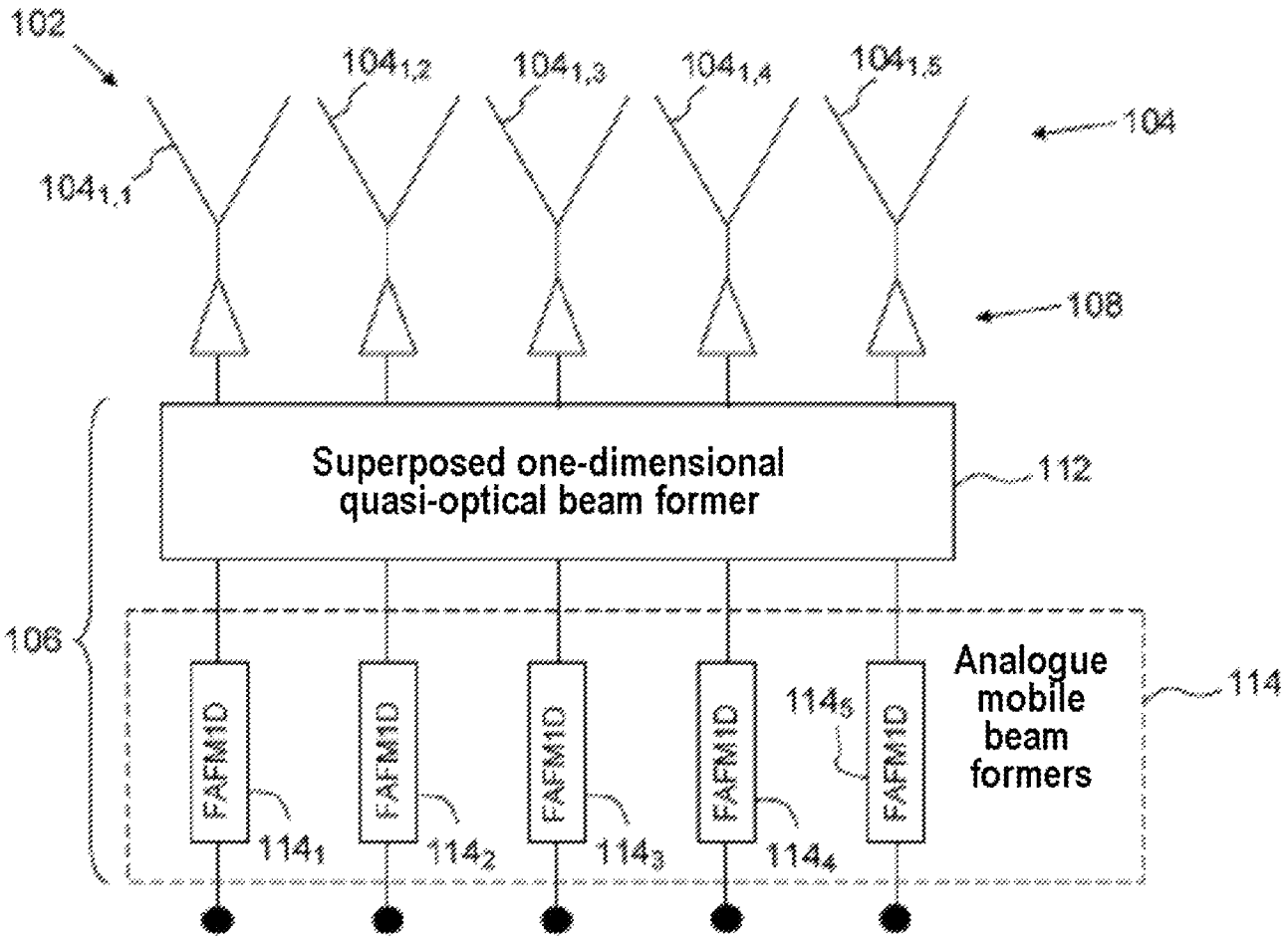
FIG. 4 is a schematic plan view of the active antenna of FIG. 3 showing only the rank of the top first level of elementary radiating feeds, aligned in the first axial direction X.
Figure 5:
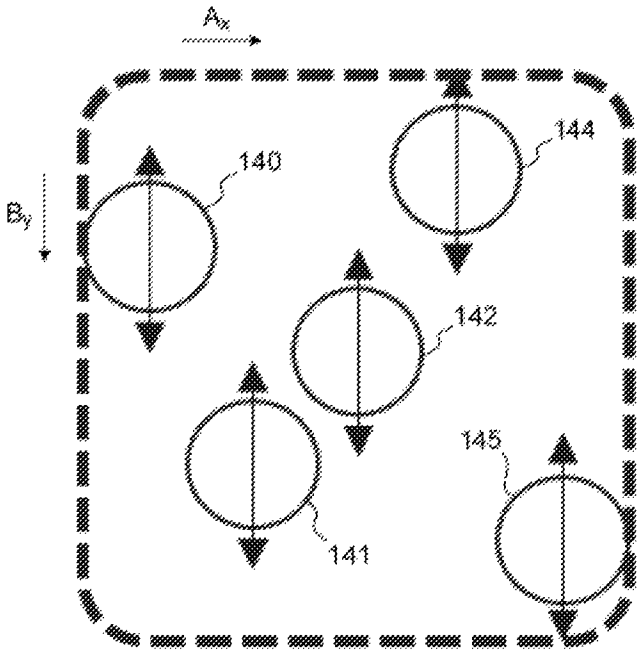
FIG. 5 is a view at a given instant of the reconfigurable transmission beams produced by the active transmission antenna of FIGS. 3 and 4 and their aptitude for mobility.

In the case of the structure of the antenna and of the multibeam former described in FIGS. 3 and 4, that means having beams mobile only on one dimension in the second angular direction By. Each of the beams is mobile on a column, all the columns being different and parallel to one another. That advantageously makes it possible to disperse the five beams 140, 141, 142, 143, 144 over all the coverage 146, as FIG. 5 shows.

As an alternative to the first embodiment, other embodiments described hereinbelow make it possible to increase the number of beams along the second angular direction By per column each corresponding to a different angular position along the first angular direction Ax, or to switch beams between several columns corresponding to different angular positions along the first angular direction Ax.

By using these variants, the flexibility of the analogue multibeam former can be improved without significantly increasing its complexity. The architectures of these variants, derived from the first embodiment, make it possible to dimension the analogue multibeam former of transmission beams to the precise requirement of the application targeted and thus significantly reduce the number of control points of the beam former by comparison to a totally flexible beam former.

Figure 6:
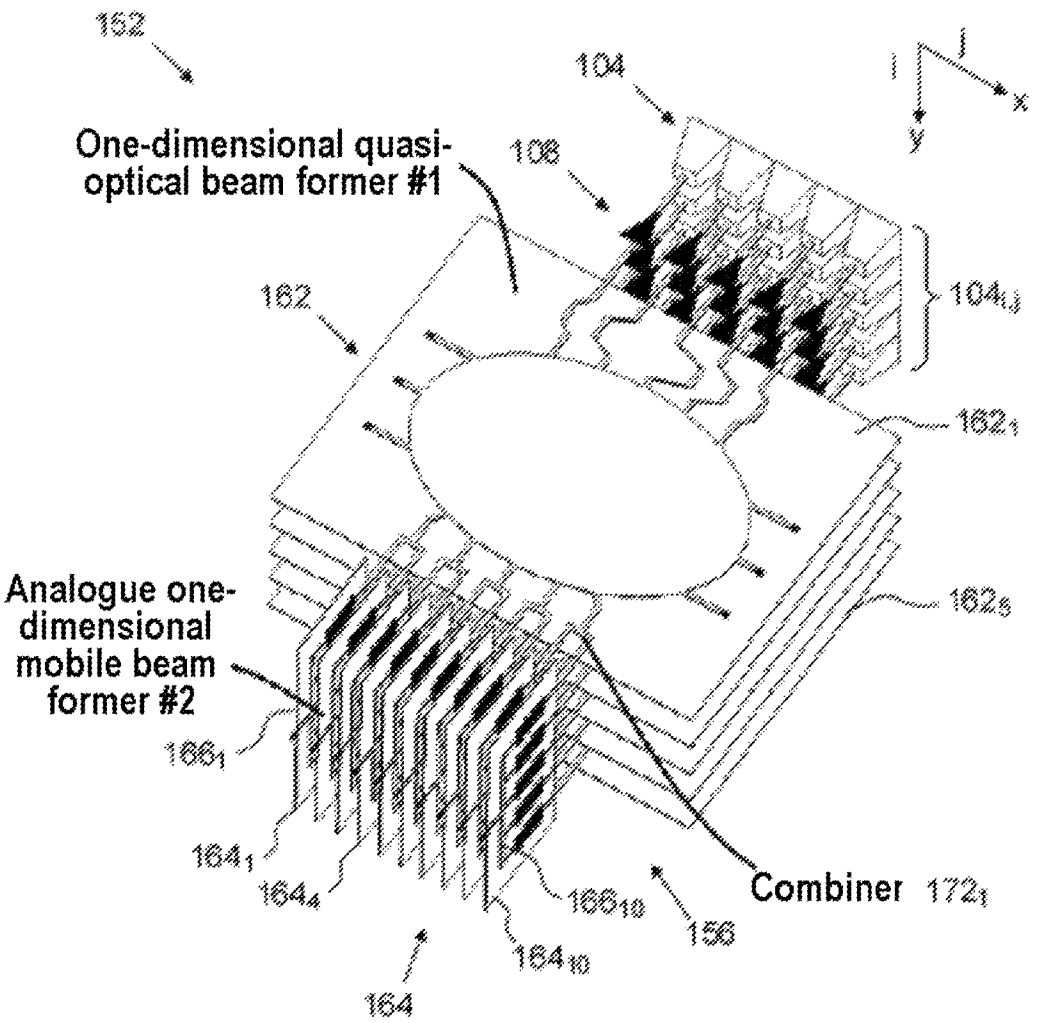
FIG. 6 is a perspective view of a second embodiment of an active transmission antenna according to the invention including its associated reconfigurable analogue multibeam former.
Figure 7:
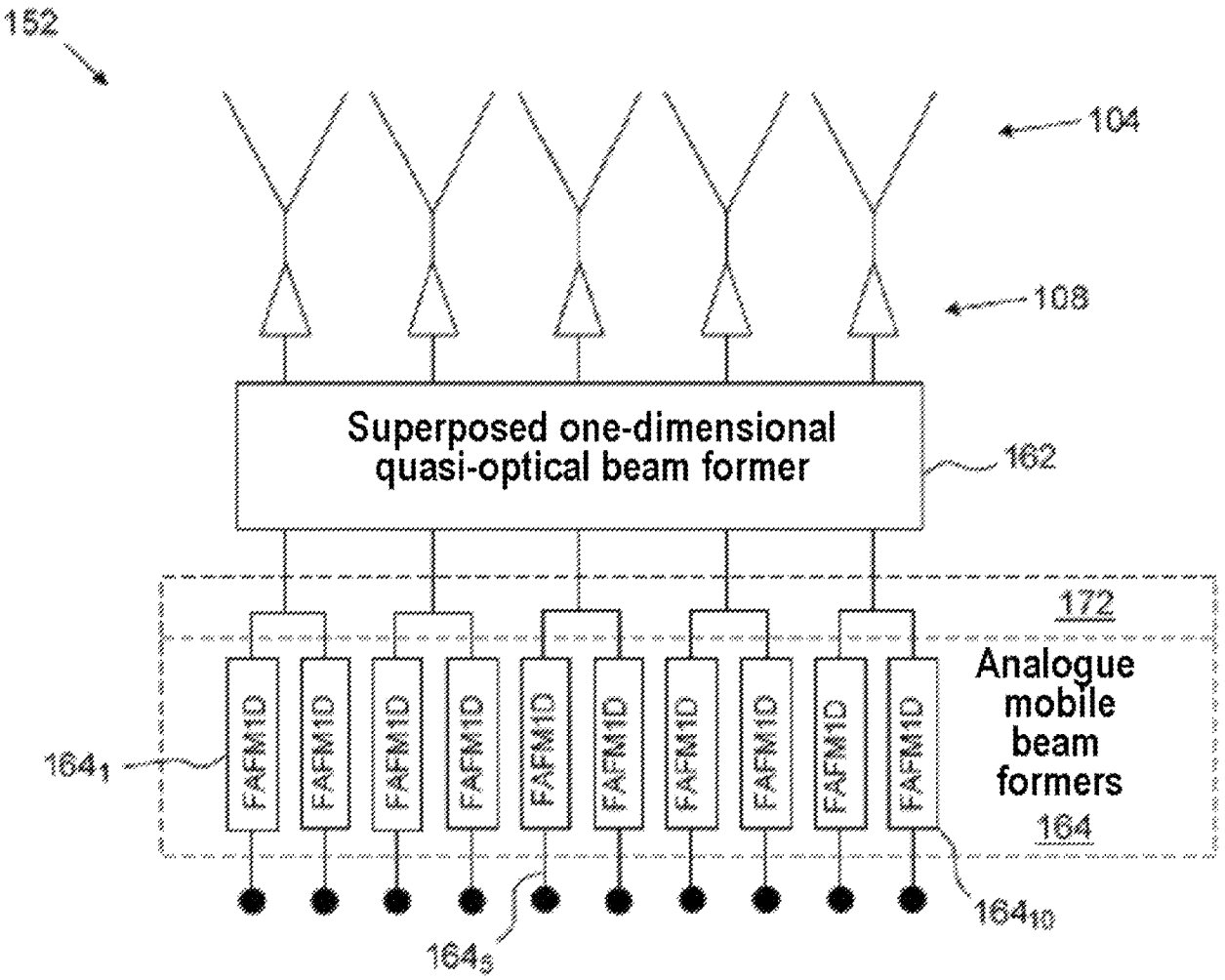
FIG. 7 is a schematic plan view of the active antenna of FIG. 6 showing only the rank of the top first level of elementary radiating feeds, aligned in the first axial direction X.
Figure 8:
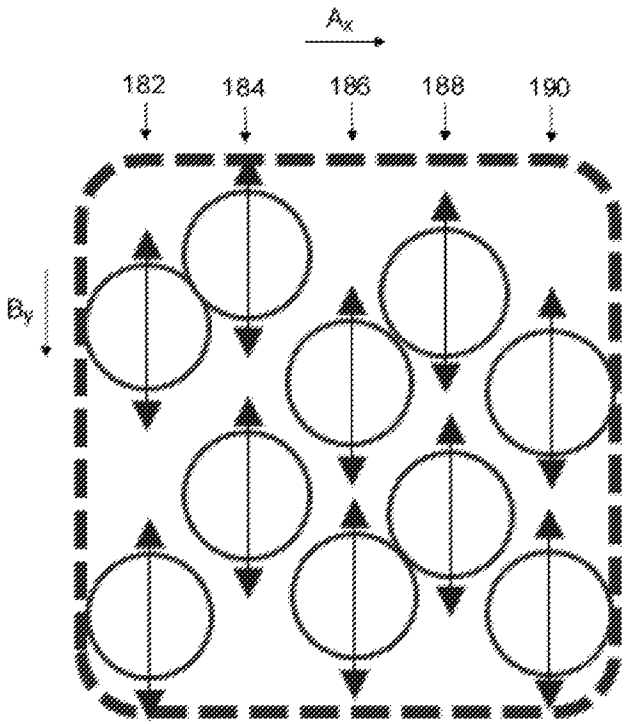
FIG. 8 is a view at a given instant of the reconfigurable transmission beams produced by the active transmission antenna of FIGS. 6 and 7 and their aptitude for mobility.

According to FIGS. 6, 7 and 8 and a second embodiment, a two-dimensional active array antenna 152, here configured in transmission mode, comprises the same antenna array 104 as that of the transmission antenna of FIG. 3, an analogue multibeam former 156 of several two-dimensional radiofrequency transmission beams of continuously variable sizes and/or aiming directions, a set 108 of power amplifiers HPA, identical to those of FIG. 3.

The analogue multibeam former 156 differs from the analogue multibeam former 106 of FIG. 3 in that it comprises, for each level i, i varying from 1 to 5 (R=5), a combiner 172*i* combining, according to a determined configuration, outputs in transmission mode of the second analogue formers 164*k*, k varying from 1 to 10 (Q=10), having the same associated level i of the first analogue former 162*i* of fixed beams in the first angular direction Ax, and in that the number Q of second analogue formers 164*k* of continuously variable beams in the second angular direction By of the second set 164 is twice that of the second set 114 of FIG. 3.

Here, each input of a second analogue former 164*k*, k varying from 1 to 10, corresponds to a different transmission beam, and the column outputs of the second analogue formers are combined pairwise by the combiners 172*i* of the first analogue formers 162*i*, *i* varying from 1 to 5.

The architecture proposed here makes it possible, as illustrated in FIG. 8, to double the number of mobile beams per column 182, in the second angular direction By, by comparison to the first embodiment, the number of columns being equal here to 5.

More generally, by placing several second analogue formers of one-dimensional mobile beams on one and the same access column of the first analogue formers of fixed beams, here of the quasi-optical formers, several mobile beams being displaced on one and the same column are obtained.

Figure 9:
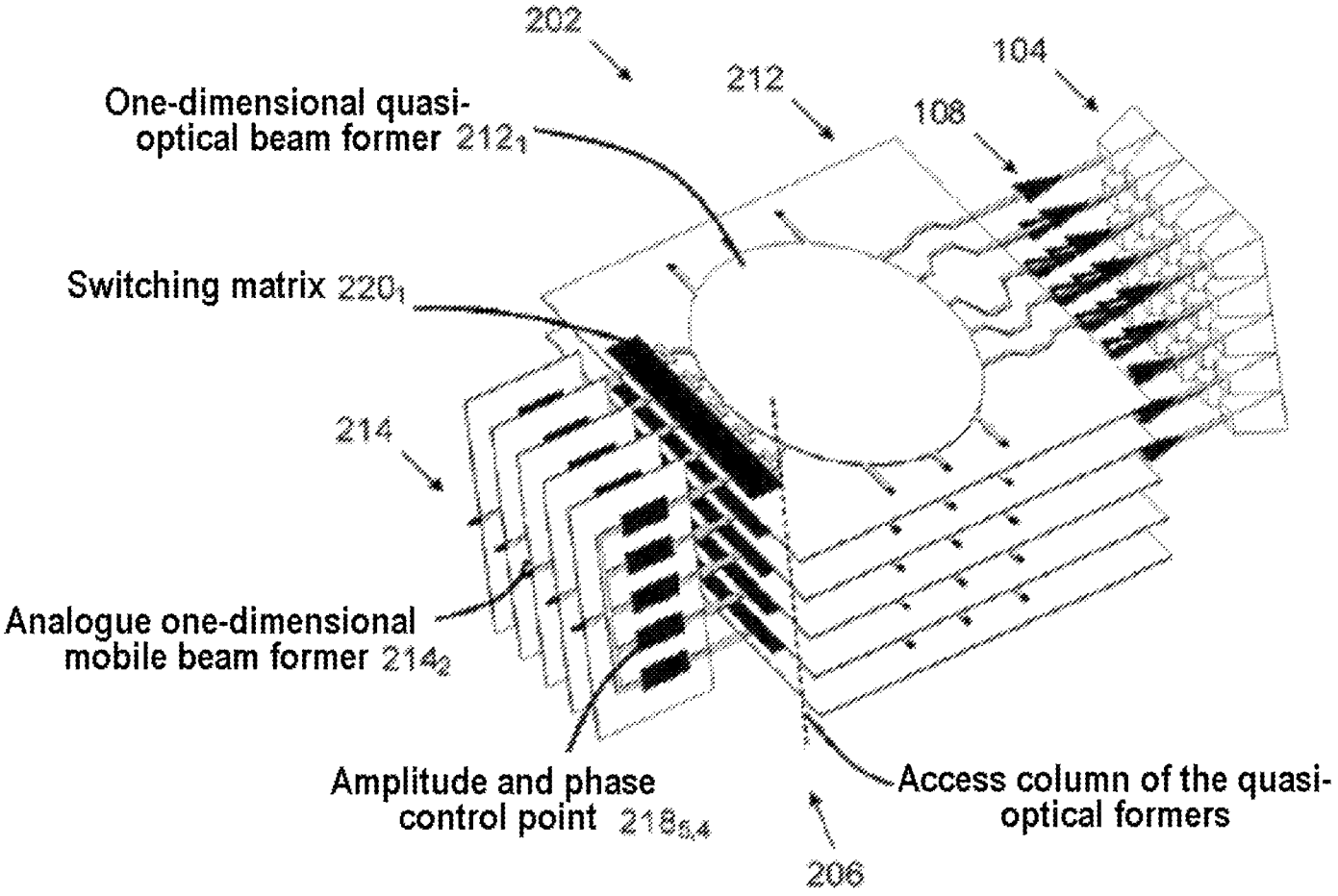
FIG. 9 is a perspective view of a third embodiment of an active transmission antenna according to the invention including its associated reconfigurable analogue multibeam former.
Figure 10:
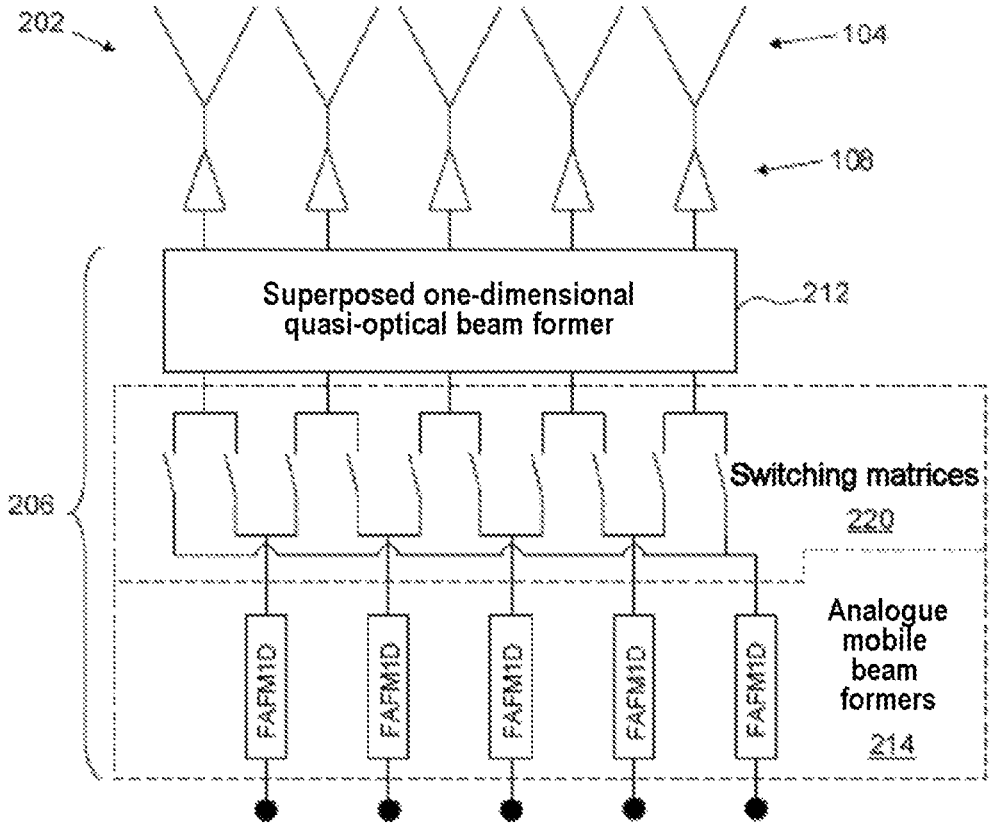
FIG. 10 is a schematic plan view of the active antenna of FIG. 9 showing only the rank of the top first level of elementary radiating feeds, aligned in the first axial direction X.
Figure 11:
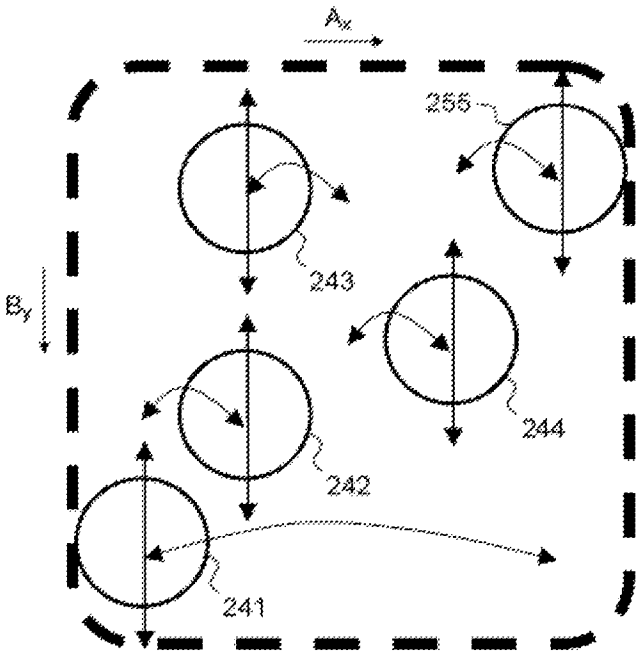
FIG. 11 is a view at a given instant of the reconfigurable transmission beams produced by the active transmission antenna of FIGS. 9 and 10 and their aptitude for mobility.

According to FIGS. 9, 10 and 11 and a third embodiment, a two-dimensional active array antenna 202, here configured in transmission mode, comprises the same antenna array 104 as that of the transmission antenna 104 of FIG. 3, an analogue multibeam former 206 of several two-dimensional radiofrequency transmission beams of continuously variable sizes and/or aiming directions, a set 108 of power amplifiers HPA, identical to those of FIG. 3.

The analogue multibeam former 206 differs from the analogue multibeam former 106 of FIG. 3 in that it comprises, inside said analogue multibeam former 206, for each level i, i varying from 1 to 5 (R=5), a first switching matrix 220*i* for switching, according to a first predetermined configuration of a set of routings, outputs in transmission mode of the second analogue formers 214*k*, k varying from 1 to 5 (Q=5), having the same associated level i of the first analogue former 212*i* of fixed beams in the first angular direction Ax.

The first switching matrices 220*i*, *i* varying from 1 to 5, are added at the inputs of the first analogue beam formers 212*i* and at the output of the second analogue formers 214*k* of beams that are continuously variable in angular position according to the second angular position By.

Here, each input of a second analogue former 214*k*, k varying from 1 to 5, corresponds to a different transmission beam.

The architecture proposed here makes it possible, as illustrated in FIG. 11, to switch the mobile beams for each column in the second angular direction By by comparison to the first embodiment, the number of columns here being equal to 5.

More generally, by adding a first switching matrix between the output accesses of the second analogue formers of one-dimensional mobile beams and the input accesses on one and the same access column of the first analogue formers of fixed beams, here quasi-optical formers, it is possible to displace the beams between several columns.

Figure 12:
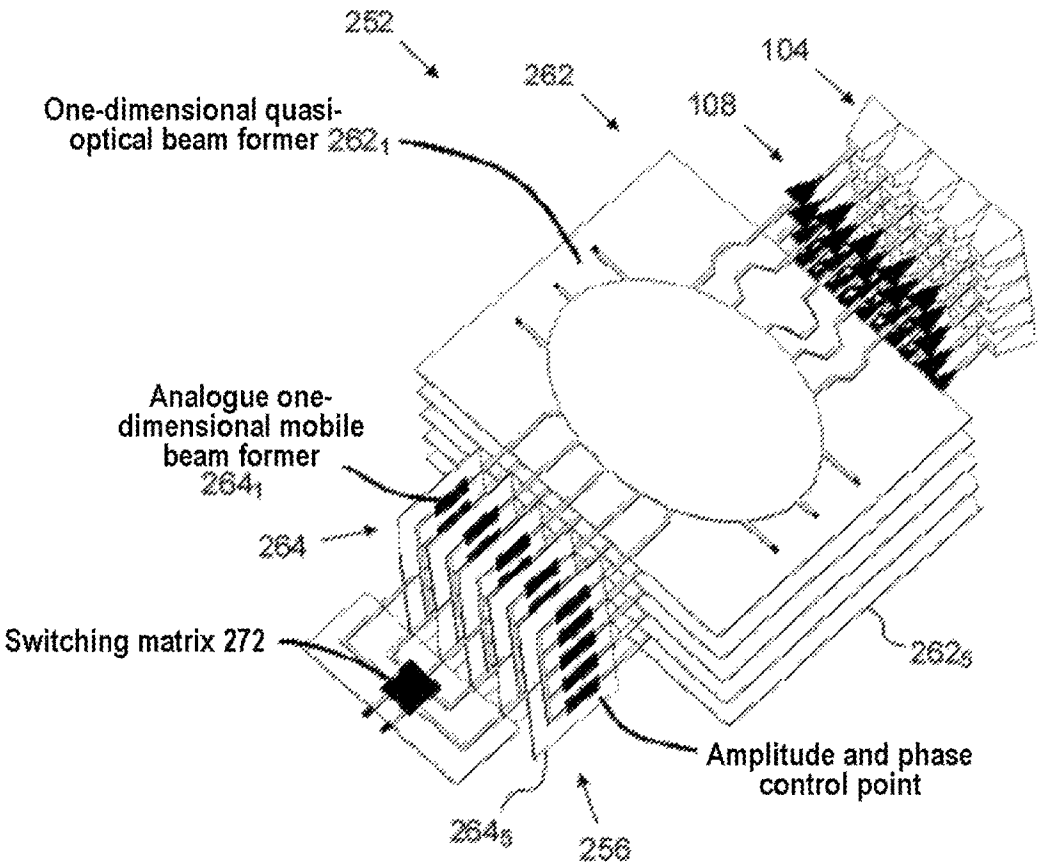
FIG. 12 is a perspective view of a fourth embodiment of an active transmission antenna according to the invention including its associated reconfigurable analogue multibeam former.
Figure 13:
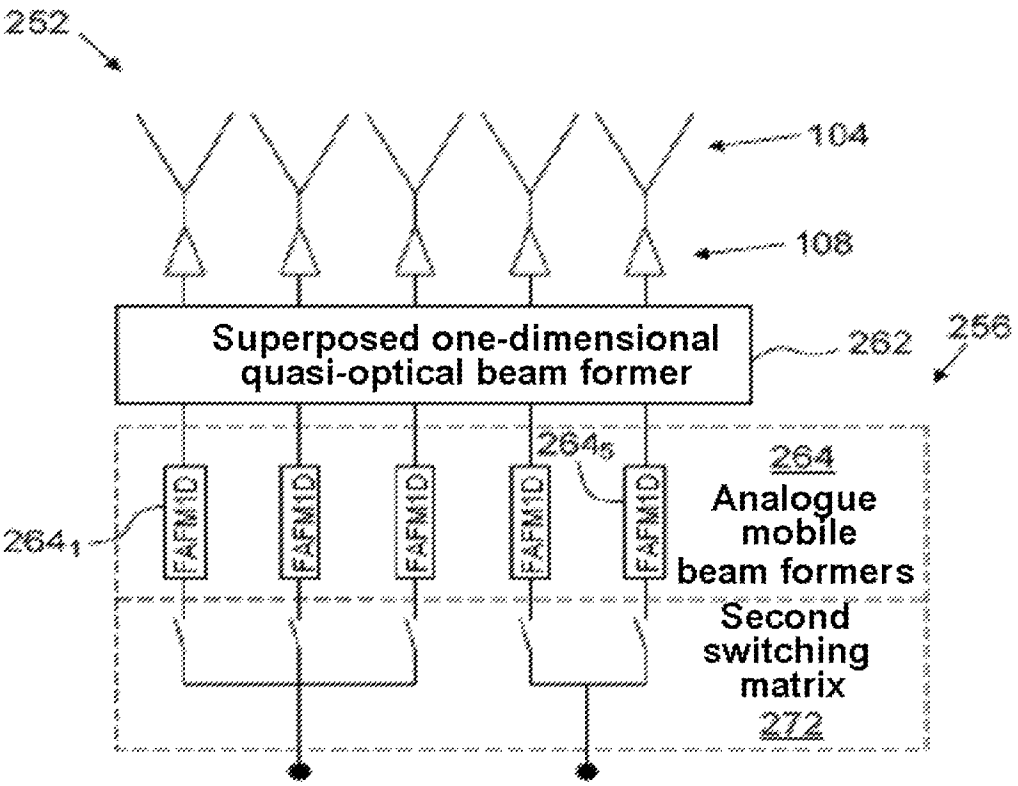
FIG. 13 is a schematic plan view of the active antenna of FIG. 12 showing only the rank of the top first level of elementary radiating feeds, aligned in the first axial direction X.
Figure 14:
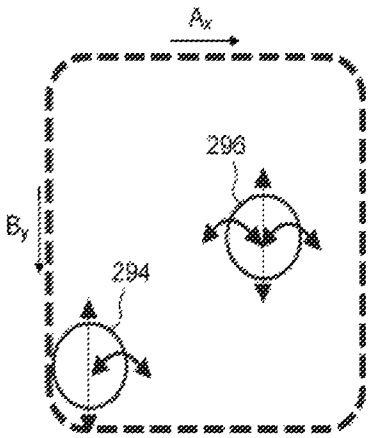
FIG. 14 is a view at a given instant of the reconfigurable transmission beams produced by the active transmission antenna of FIGS. 12 and 13 and their aptitude for mobility.

According to FIGS. 12, 13, 14 and a fourth embodiment, a two-dimensional active array antenna 252, here configured in transmission mode, comprises the same antenna array 104 as that of the transmission antenna 102 of FIG. 3, an analogue multibeam former 256 of several two-dimensional radiofrequency transmission beams of continuously variable sizes and/or aiming directions, a set 108 of power amplifiers HPA, identical to those of FIG. 3.

The analogue multibeam former 256 differs from the analogue multibeam former 106 of FIG. 3 in that it comprises, peripheral to said two-dimensional analogue multibeam former 256 and opposite the access channels to the radiating feeds $\mathbf{104}_{i,j}$ of the antenna array 104, a second switching matrix 272 for switching, according to a second predetermined configuration of a set of routings, the Q inputs in transmission mode of the second analogue formers 264*k*, k varying from 1 to 5 (Q=5).

The second switching matrix 272 is added at the input of the second analogue formers 264*k*, k varying from 1 to 5, of beams that are continuously variable in angular position according to the second angular position By.

The architecture proposed here makes it possible, as illustrated in FIG. 14, to reduce the number of beams in the coverage 292 to two beams 294, 296. Compared to the first embodiment of FIG. 3, the number of beams changes from five to two.

More generally, by adding a second switching matrix at the input of the second analogue formers of one-dimensional mobile beams, the number of beam accesses, the number of beams at a given instant, is reduced.

Figure 15:
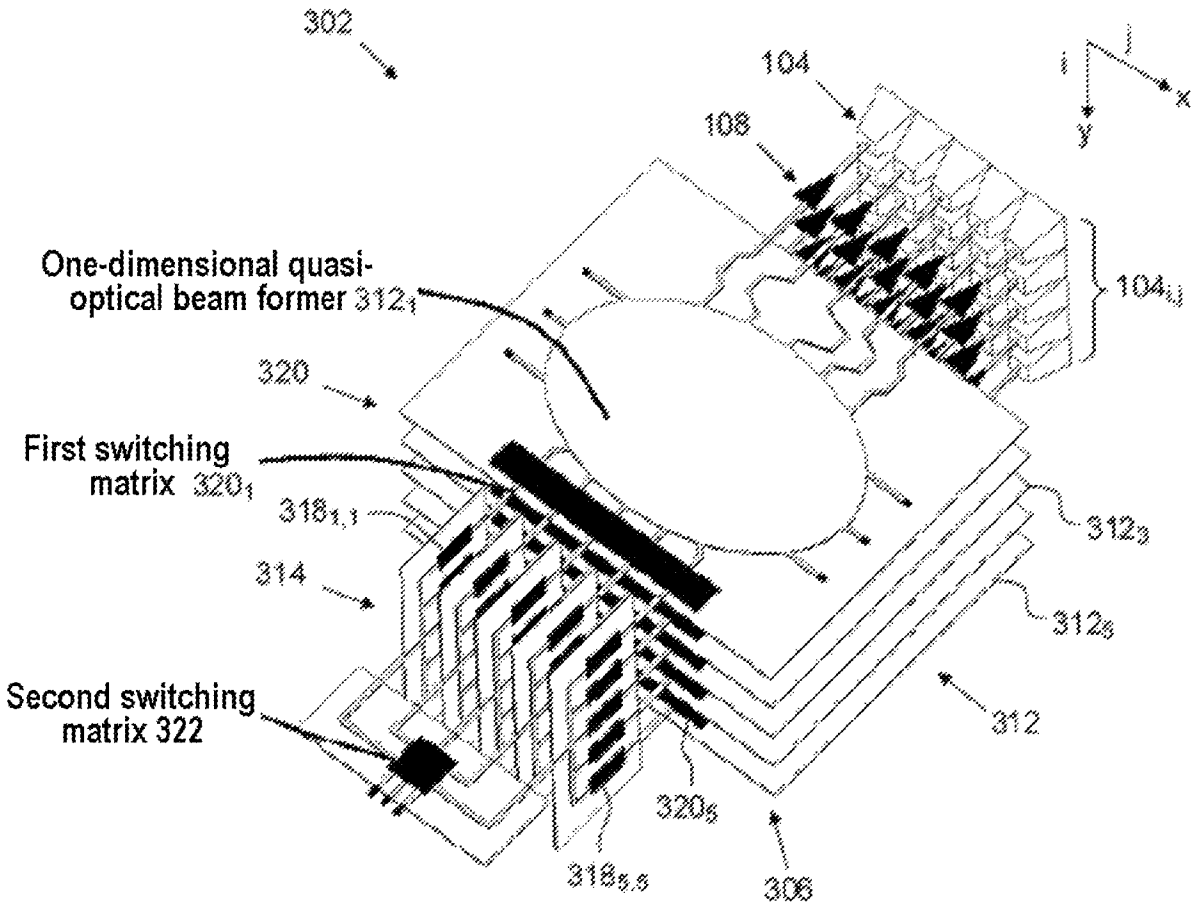
FIG. 15 is a perspective view of a fifth embodiment of an active transmission antenna according to the invention including its associated reconfigurable analogue multibeam former.
Figure 16:
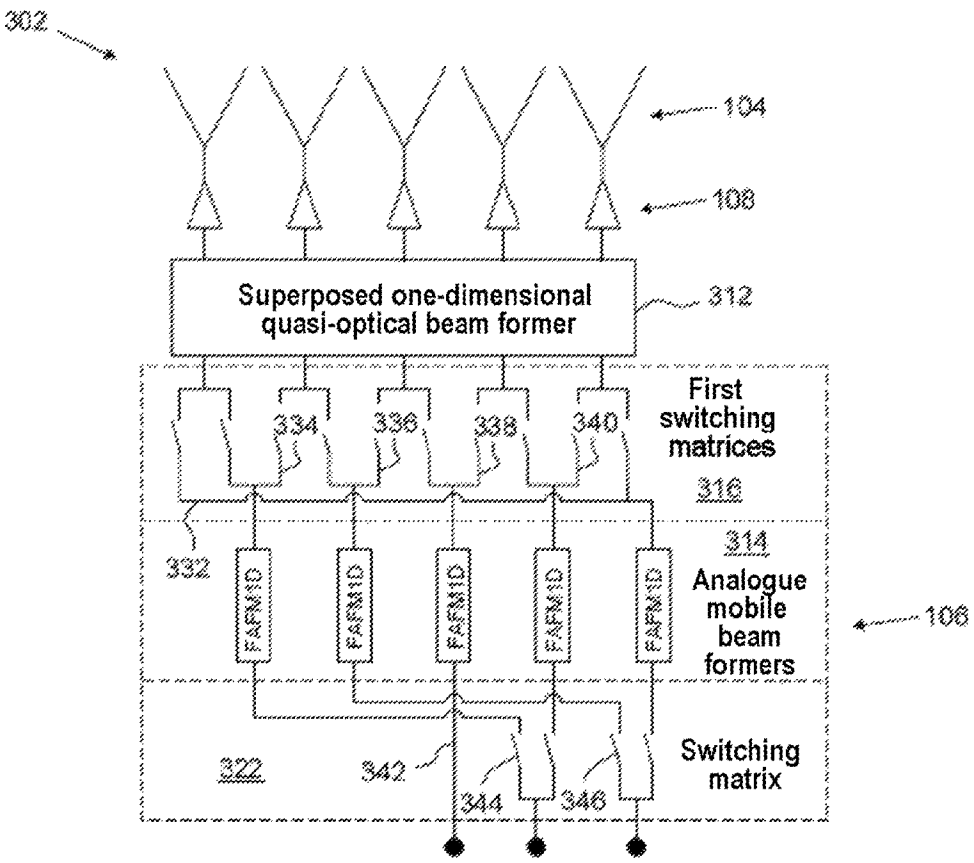
FIG. 16 is a schematic plan view of the active antenna of FIG. 15 showing only the rank of the top first level of elementary radiating feeds, aligned in the first axial direction X.
Figure 17:
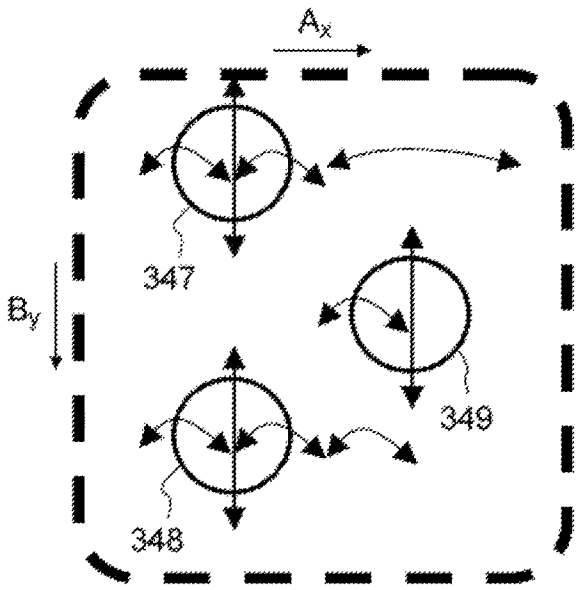
FIG. 17 is a view at a given instant of the reconfigurable transmission beams produced by the active transmission antenna of FIGS. 15 and 16 and their aptitude for mobility.

According to FIGS. 15, 16 and 17 and a fifth embodiment, a two-dimensional active array antenna 302, here configured in transmission mode, comprises the same antenna array 104 as that of the transmission antenna 102 of FIG. 3, an analogue multibeam former 306 of several two-dimensional radiofrequency transmission beams of continuously variable sizes and/or aiming directions, a set 108 of power amplifiers HPA, identical to those of FIG. 3.

The analogue multibeam former 306 differs from the analogue multibeam former 106 of FIG. 3 in that it comprises:

for each first analogue former 312*i* and the associated level i, i varying from 1 to 5 (R=5), inside the two-dimensional analogue multibeam former 306, a first switching matrix 320*i* for switching, according to a first configuration of a predetermined set of routings, the outputs in transmission mode of the second analogue formers 314*k*, k varying from 1 to 5 (Q=5), having the same associated level i of the first analogue former 312*i* of fixed beams in the first angular direction Ax; and peripheral to the two-dimensional analogue multibeam former 306 and opposite the access channels to the radiating feeds $\mathbf{104}_{i,j}$ of the antenna, a second switching matrix 322 for switching, according to a second configuration of a predetermined set of routings, the Q inputs in transmission mode of the second analogue formers 314*k* to an integer number T, greater than or equal to 2 and less than or equal to Q, of beam inputs in transmission mode.

Each first matrix 320*i* associated with a given level i, i varying from 1 to 5, interposed between the first analogue beam former 316*i* of the same level i, here comprises five switches 332, 334, 336, 338, 340 with one input and two outputs.

The second switching matrix 322, connected at the input of the second set 314 of second analogue beam formers 314*k*, here comprises a fixed connection line 342 and two switchers or switches 344, 346 with one input and two outputs.

The architecture proposed here is a hybrid architecture of the third and fourth embodiments and, as illustrated in FIG. 17, this architecture makes it possible to reduce the number of beams by switching from five to three beams 347, 348, 349, and to switch, for each column, the beams, continuously mobile in the second angular direction By, of the three columns.

Generally, the generalized architectures of the second, third and fourth embodiments can be combined.

Figure 18:
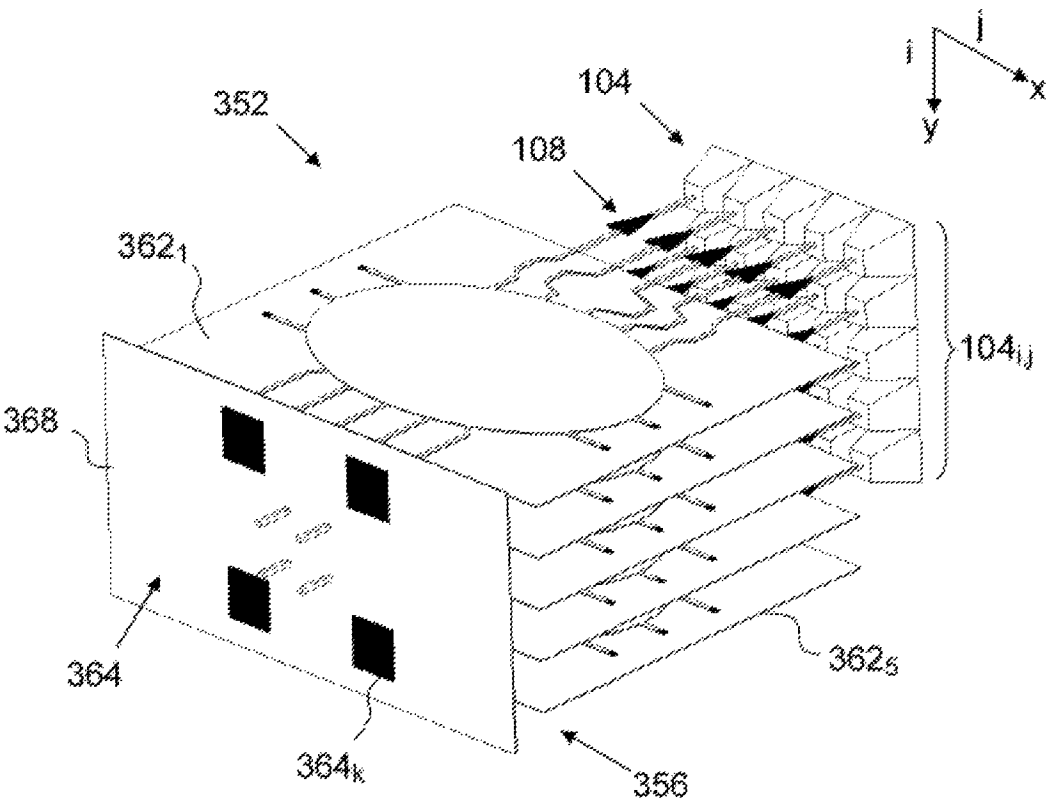
FIG. 18 is a perspective view of a sixth embodiment of an active transmission antenna according to the invention including its associated reconfigurable analogue multibeam former.

According to FIG. 18 and a sixth embodiment, a two-dimensional active array antenna 352, here configured in transmission mode, comprises the same antenna array 104 as that of the transmission antenna of FIG. 3, an analogue multibeam former 356 of several two-dimensional radiofrequency transmission beams of continuously variable sizes and/or aiming directions, and a set 108 of power amplifiers HPA, identical to those of FIG. 3.

The analogue multibeam former 356 differs from the analogue multibeam former of FIG. 3 in that it comprises four beam inputs and at least one second second switching matrix for reduction to four beams.

Here, the five second analogue formers 364*k*, k varying from 1 to 5, of the second set 364, are integrated on a single circuit 368 placed on a plane at right angles to those of the quasi-optical formers 362*i*, *i* varying from 1 to 5.

Generally, and independently of the architecture of the analogue multibeam former according to the invention that is used, the second analogue formers of mobile beams of the second set are integrated in a single circuit of planar form, the integrated circuit being disposed in a plane at right angles to the planes of extension of the circuits of the first analogue formers of fixed beams and endwise abutting the edges of said circuits, parallel to one another and contained in one and the same plane.

All of the embodiments of the analogue multibeam former described above use first analogue formers of fixed beams, produced by quasi-optical formers. As an alternative, the first analogue formers of fixed beams can be produced by other types of fixed analogue beam formers such as Butler matrices.

The analogue multibeam formers described above can be used with:

- a system time-sharing one or more beam accesses between several distinct beams over the coverage of the antenna according to the time division multiple access principle;

an additional digital beam forming stage with, potentially, a pre-coding function.

The first, second, third, fourth, fifth and sixth embodiments described above in FIGS. 3 to 18 of the active transmission antennas, and their associated analogue formers according to the invention, are configured to generate transmission beams of identical sizes.

As a variant of the configurations described above, different settings of the first analogue formers of fixed beams in the first angular direction and of the second analogue formers of mobile beams in the second angular direction By can be used to generate transmission beams of different sizes.

Figure 19:
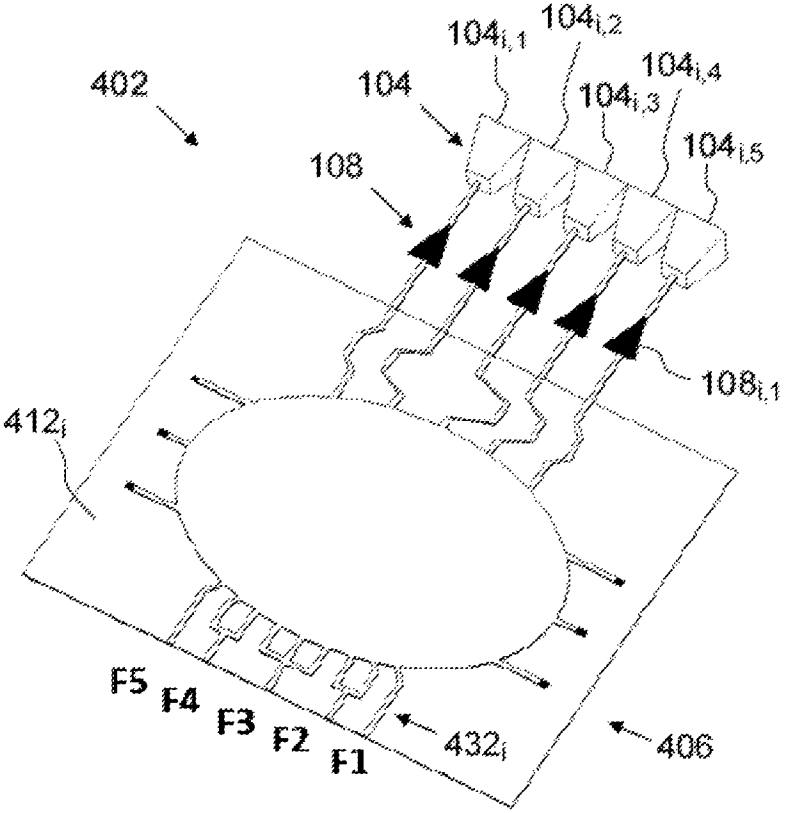
FIG. 19 is a perspective view of a seventh embodiment of an active transmission antenna according to the invention including its associated reconfigurable analogue multibeam former, the view being limited to one rank of elementary radiating feeds, aligned in a first axial direction X and situated at any given level, and being limited to the components (a first one-dimensional analogue fixed beam former and a divider) connected to said rank of feeds, situated just downstream of a first set, not represented, of second analogue formers of mobile beams.

According to FIG. 19 and a seventh embodiment, a two-dimensional active array antenna 402, here configured in transmission mode, comprises the same antenna array 104 as that of the transmission antenna 102 of FIG. 3, an analogue multibeam former 406 of several two-dimensional radiofrequency transmission beams of continuously variable sizes and/or aiming directions, a set 108 of power amplifiers HPA, identical to those of FIG. 3.

The analogue multibeam former 406 differs from the analogue multibeam former 106 of FIG. 3 in that it comprises, for each first analogue former of one-dimensional beams and the associated level i, i varying from 1 to 5 (R=5), connected to the inputs of said first analogue former 412*i* of fixed transmission beams, a divider 432*i* according to a configuration of division of the outputs of the second analogue beam formers having the same associated level i of said first analogue former 412*i* of fixed beams.

The configuration of division of the divider 432*i* is a function of a predetermined pattern of the widths of the transmission beams in the first angular direction Ax, in which the single accesses of the beams F1, F2, F3, F4, F5 at the output of the five second formers of mobile beams, not represented in FIG. 19, are divided respectively into one, two, three, two, one branches which each access a single associated input of the first quasi-optical beam former.

Figure 20:
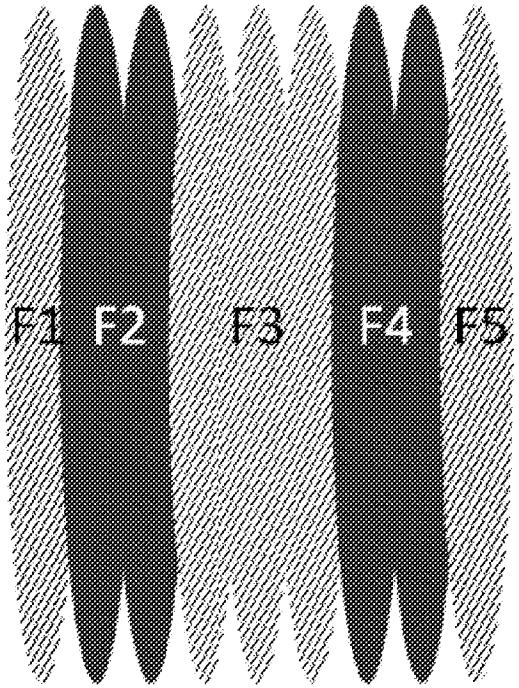
FIG. 20 is a view at a given instant of the transmission beams produced by just the rank of feeds of the antenna of FIG. 19.
Figure 21:
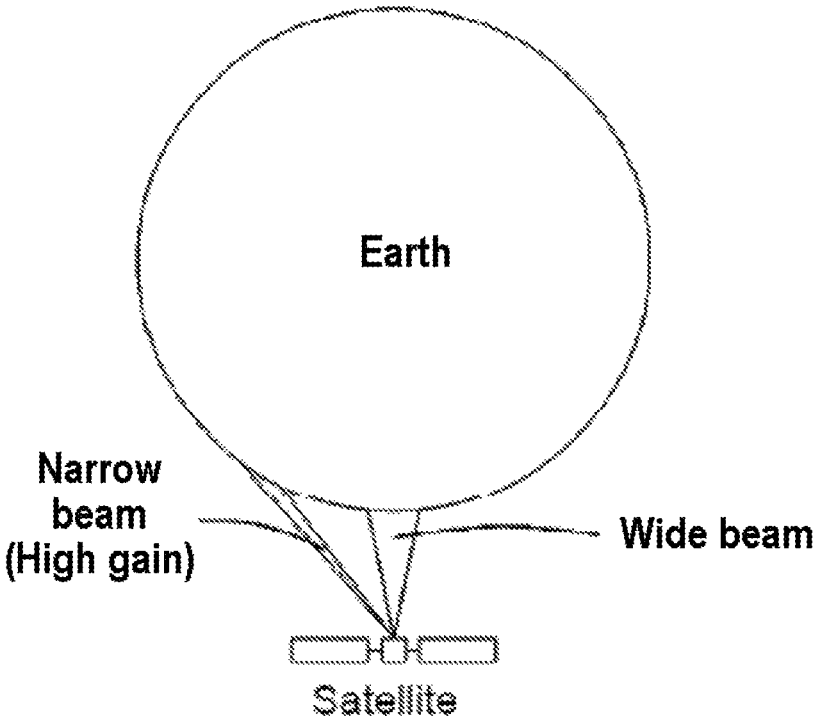
FIG. 21 is a view of the illumination of the surface of the Earth by a multibeam satellite antenna that makes it possible to view the dependency of the flux received in a given beam as a function of the aiming angle of the beam relative to the nadir of the satellite and the width of the beam.

Thus, the elementary dividers of each divider 432*i*, connected at the input to the first one-dimensional analogue beam former 412*i*, of the same level i and formed here by a first quasi-optical beam former, are configured so as to obtain an increase in gain as the beams are moved away from the centre of the phase centre of the antenna by being separated therefrom in a first angular direction Ax. As illustrated in FIGS. 20 and 21, the purpose of this gain variation can be to compensate for the increase in the propagation losses between a satellite and the Earth when the propagation path becomes longer and the increased footprints on the ground when the angular of projection on the ground becomes greater as the beams transmitted from the satellite move away from the centre. This compensation makes it possible to provide different users distributed over the Earth with a quasi-equivalent signal level (isoflux).

Figure 22:
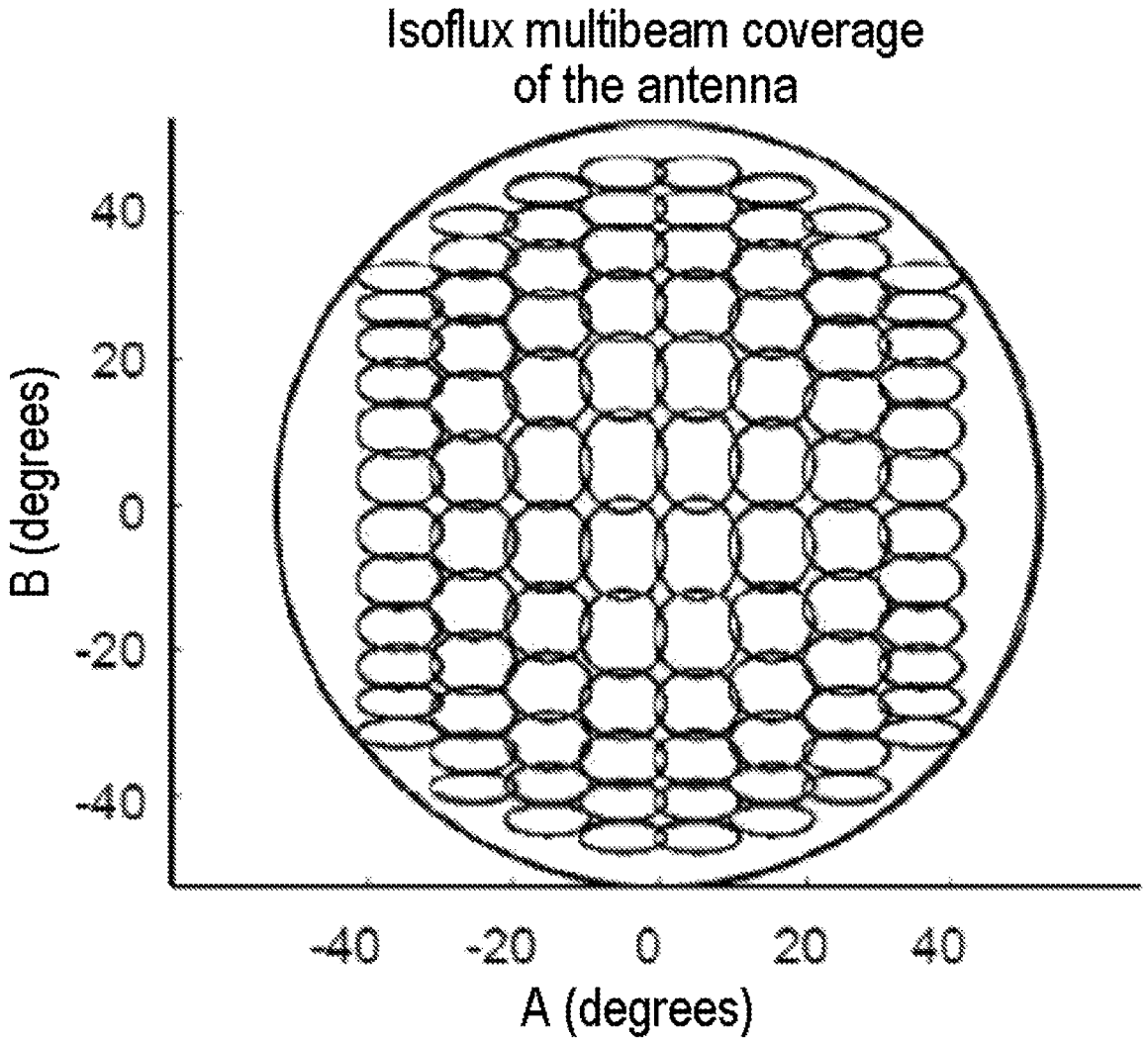
FIG. 22 is a view of iso-flux radiation patterns produced by an active antenna of an eighth embodiment of the invention by adjusting only the amplitude and phase control points of the second analogue mobile beam formers.

According to FIG. 22, this variation of the gain of the beams can also be obtained by acting only on the amplitude and phase control points of 12 mobile electronic formers of an eighth embodiment of an active array according to the invention that is not represented. The variation of the size of a beam can also be dictated by a need to cover a greater or lesser surface area with this beam.

Generally, a two-dimensional active transmission antenna according to the invention, as represented in FIG. 1, has reduced complexity and is reconfigurable to transmit radiofrequency signals over a plurality of transmission beams of continuously variable sizes and/or aiming directions. The reconfigurable two-dimensional active transmission antenna according to the invention comprises an antenna array of elementary radiating transmission feeds, a set of RF power amplifiers HPA, and a two-dimensional analogue multibeam former.

The antenna array of radiating transmission feeds is formed by a total integer number N, greater than or equal to 4, of elementary RF radiating transmission feeds, distributed over a planar or curved surface according to a mesh formed by the points of intersection of a first series of a first integer number R, greater than or equal to 2, of parallel lines in a first axial direction X, and of a second series of a second integer number S, greater than or equal to 2, of parallel lines in a second axial direction Y, different from the first axial direction X.

The two-dimensional analogue multibeam former comprises a first set in which there are superposed S first analogue formers of one-dimensional fixed beams of identical structure in the second axial direction Y.

The R first analogue formers of one-dimensional fixed beams are configured to form P fixed radiofrequency transmission beams in first fixed angular aiming directions Ax along the first axial direction X.

Each first one-dimensional analogue beam former is connected through R output channels in transmission mode, corresponding to a row of R elementary radiating feeds of the antenna array and corresponding to a different line of the mesh of the active antenna, identified by a level index j.

Each first analogue former has an integer number P, greater than or equal to 2, of input channels in transmission mode, numbered by an index of progression i along the first axial direction X.

The analogue multibeam former also comprises a second set of an integer number Q of second analogue formers of radiofrequency beams that are continuously variable in size and/or in aiming direction in second angular aiming directions By along the second axial direction Y.

Each second analogue former is formed by a divider with a single input and R output branches in transmission mode, each output branch of a divider including an amplitude and phase control point. Each second analogue former of the second set is connected at least one access column of the first set, an access column being formed by S access terminals to the input channels of the same rank i of the first analogue formers.

It should be noted that the same architectures of the reconfigurable active multibeam transmission antennas and their associated two-dimensional analogue multibeam formers according to the invention, described in FIGS. 3 to 22, can be used correspondingly in reconfigurable active multibeam reception antennas. The reconfigurable active multibeam reception antennas are the reconfigurable active multibeam transmission antennas of FIGS. 3 to 22 in which the power radiofrequency amplifiers HPA have been replaced by low-noise radiofrequency amplifiers LNA.

Generally, a two-dimensional active reception antenna according to the invention, as represented in FIG. 2, has reduced complexity and is reconfigurable to receive radiofrequency RF signals over a plurality of reception beams of continuously variable sizes and/or aiming directions. The two-dimensional active reception antenna according to the invention comprises an antenna array of elementary radiating feeds, a set of low-noise RF amplifiers (LNA), and a two-dimensional analogue multibeam former.

The antenna array of radiating feeds is formed by a total integer number N, greater than or equal to 4, of elementary RF radiating feeds, distributed over a planar or curved surface according to a mesh formed by the points of intersection of a first series of a first integer number R, greater than or equal to 2, of parallel lines in a first axial direction X, and of a second series of a second integer number S, greater than or equal to 2, of parallel lines in a second axial direction Y, different from the first axial direction X.

The two-dimensional analogue multibeam former comprises a first set in which there are superposed R first analogue formers of identical structure and configured to form P fixed radiofrequency beams in first angular aiming directions Ax along the first axial direction X, each first analogue former being configured to be connected through R input channels in reception mode, corresponding to a row of R radiating feeds of the antenna array and corresponding to a different line of the mesh of the antenna, identified by a level index j; and each analogue former having an integer number P, greater than or equal to 2, of output channels in reception mode, numbered by an index of progression i along the first axial direction X.

The analogue multibeam former in reception mode also comprises a second set of an integer number Q of second analogue formers of radiofrequency beams that are continuously variable in size and/or in aiming direction in second angular aiming directions By along the second axial direction Y.

Each second analogue former is formed by a combiner with a single output and R input branches in reception mode, each input branch of a combiner including an amplitude and phase control point. Each second analogue former of the second set is connected to at least one access column of the first set, an access column being formed by S access terminals to the output channels of the same rank i of the first analogue formers.

Even more generally, an analogue multibeam former according to the invention is configured to form several two-dimensional radiofrequency beams of continuously variable sizes and/or aiming directions of a reconfigurable two-dimensional active array antenna having an antenna array.

The antenna array is formed by a total integer number M, greater than or equal to 4, of radiating feeds, distributed over a compact and single-piece portion D of a planar or curved surface according to a compact stack of an integer number R, greater than or equal to 2, of rows r(i) that are parallel to one another and oriented in a first local axial direction X, the stack being oriented in a second axial direction Y, different from the first local axial direction X. i designates a level and numbering index from 1 to R in the direction of progression of the second axial direction Y of stacking of said rows r(i). Each row r(i), i varying from 1 to R, has an integer number S(i) that is a function of the level i of radiating feeds, the sum of the integers S(i), i varying from 1 to R, being equal to the number M.

The analogue multibeam former comprises a first set in which there are superposed R first analogue formers of identical structure and configured to form a number P, greater than or equal to 2, of fixed radiofrequency beams in first angular aiming directions Ax that are fixed along the first local axial direction X. Each first analogue former associated with the level i, i varying from 1 to R, is configured to be connected through the integer number S(i) of output channels in transmission mode or S(i) of input channels in reception mode, corresponding to the row r(i) of the S(i) radiating feeds of the antenna array. Each first analogue former has P input channels in transmission mode or output channels in reception mode, numbered by an index of progression j along the first axial direction X.

The analogue multibeam former comprises a second set of an integer number Q of second analogue formers of radiofrequency beams that are continuously variable in size and/or in aiming direction in second angular aiming directions By along the second axial direction Y. Each second analogue former is formed by a divider with a single input and R output branches in transmission mode or by a combiner with a single output and R input branches in reception mode, each output branch of a divider in transmission mode or input branch of a combiner in reception mode including an amplitude and phase control point. Each second analogue former of the second set is connected to at least one access column of the first set of first beam formers, an access column being formed by R access terminals to the input channels of the same rank of the first analogue formers.

Correspondingly, a two-dimensional active multibeam transmission antenna or a two-dimensional active multibeam reception antenna uses a generalized analogue multibeam former as described above.

Figure 23:
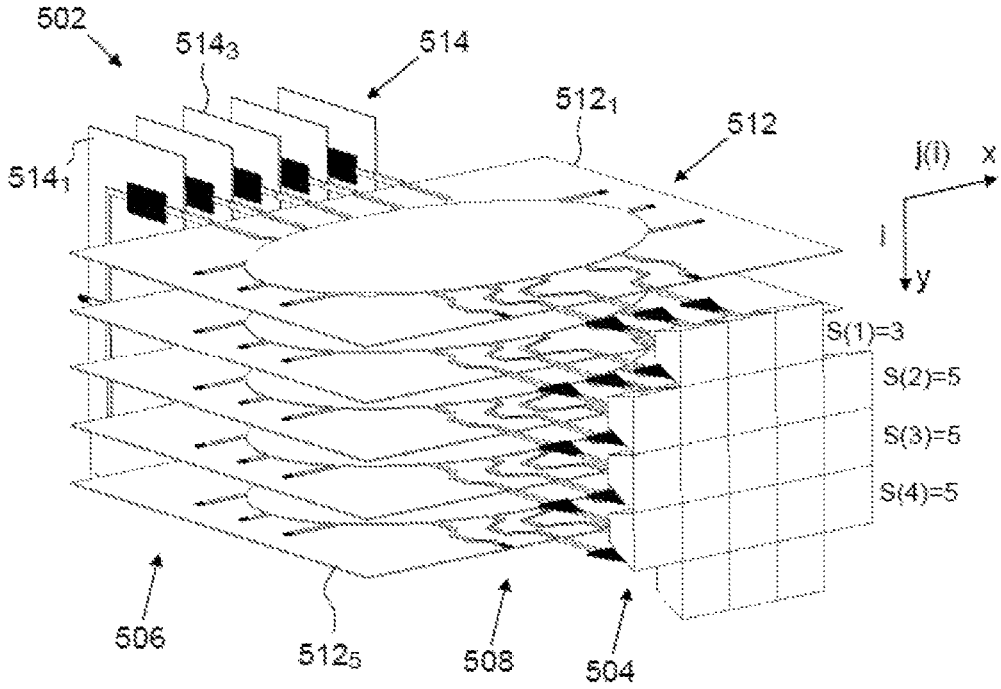
FIG. 23 is a perspective view of a ninth embodiment of an active transmission antenna according to the invention including its associated reconfigurable analogue multibeam former.

According to FIG. 23 and a ninth embodiment, a two-dimensional active array antenna 502, here configured in transmission mode, comprises an antenna array 504 that is different from that of the transmission antenna 102 of FIG. 3, an analogue multibeam former 506 of several two-dimensional radiofrequency transmission beams of continuously variable sizes and/or aiming directions, a set 508 of power amplifiers HPA, different from those of FIG. 3.

The antenna array 504 is formed by a total number M, here equal to 21, of radiating feeds, distributed over a compact and single-piece portion D of a planar or curved surface according to a compact stack of an integer number R, here equal to 5, of rows r(i) that are parallel to one another and oriented in a first local axial direction X, the stack being oriented in a second axial direction Y, different from the first local axial direction X, the level index i varying from 1 to 5 in the direction of progression of the second axial direction Y of stacking of said rows r(i). The numbers S(1), S(2), S(3), S(4), S(5) of radiating feeds of the rows r(1), r(2), r(3), r(4), r(5) are respectively equal to 3, 5, 5, 5, 3.

The sum of the integers S(i), i varying from 1 to 5, is equal to the number M, here having the value 21.

The analogue multibeam former 506 comprises a first set 512 in which there are superposed 5 first analogue formers of identical structure and configured to form a number P, here equal to 5, of fixed radiofrequency beams in first angular aiming directions Ax that are fixed along the first local axial direction X. Each first analogue former 512*i* associated with the level i, i varying from 1 to 5, is configured to be connected through the integer number S(i) of output channels in transmission mode, corresponding to the row r(i) of the S(i) radiating feeds of the antenna array. Each first analogue former has five input channels in transmission mode.

The analogue multibeam former 506 comprises a second set of an integer number Q, here equal to 5, of second analogue formers 514*k*, k varying from 1 to 5, of radiofrequency beams that are continuously variable in size and/or in aiming direction in second angular aiming directions By along the second axial direction Y. Each second analogue former 514*k*, k varying from 1 to 5, is formed by a divider with a single input and five output branches in transmission mode, each output branch of a divider in transmission mode including an amplitude and phase control point. Each second analogue former 514*k* of the second set 514 is connected to at least one access column of the first set of first beam formers, an access column being formed by five access terminals to the input channels of the same rank of the first analogue formers 512*i*.

Figure 24:
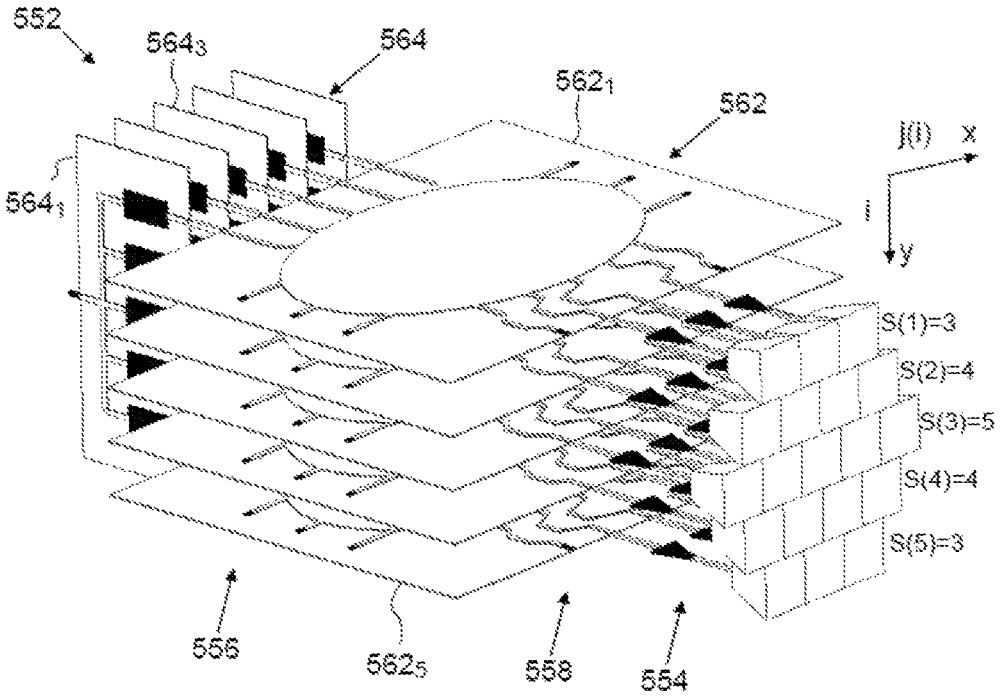
FIG. 24 is a perspective view of a tenth embodiment of an active transmission antenna according to the invention including its associated reconfigurable analogue multibeam former.

According to FIG. 24 and a tenth embodiment, a two-dimensional active array antenna 552, here configured in transmission mode, comprises an antenna array 554 that is different from that of the transmission antenna 102 of FIG. 3 and from the transmission antenna of FIG. 23, an analogue multibeam former 556 of several two-dimensional radiofrequency transmission beams of continuously variable sizes and/or aiming directions, a set 508 of power amplifiers HPA that is different from that of FIG. 3.

The antenna array 554 is formed by a number total M, here equal to 19, of radiating feeds, distributed over a compact and single-piece portion D of a planar or curved surface according to a compact stack of an integer number R, here equal to 5, of rows r(i) that are parallel to one another and oriented in a first local axial direction X, the stack being oriented in a second axial direction Y, different from the first local axial direction X, the level index i varying from 1 to 5 in the direction of progression of the second axial direction Y of stacking of said rows r(i). The numbers S(1), S(2), S(3), S(4), S(5) of radiating feeds of the rows r(1), r(2), r(3), r(4), r(5) are respectively equal to 3, 4, 5, 4, 3.

The sum of the integers S(i), i varying from 1 to 5, is equal to the number M, here having the value 19.

The analogue multibeam former 556 comprises a first set 562 in which there are superposed five first analogue formers of identical structure and configured to form a number P, here equal to 5, of fixed radiofrequency beams in first angular aiming directions Ax that are fixed along the first local axial direction X. Each first analogue former 562*i* associated with the level i, i varying from 1 to 5, is configured to be connected through the integer number S(i) of output channels in transmission mode, corresponding to the row r(i) of the S(i) radiating feeds of the antenna array. Each first analogue former has five input channels in transmission mode.

The analogue multibeam former 506 comprises a second set of an integer number Q, here equal to 5, of second analogue formers 564*k*, k varying from 1 to 5, of radiofrequency beams that are continuously variable in size and/or in aiming direction in second angular aiming directions By along the second axial direction Y. Each second analogue former 564*k*, k varying from 1 to 5, is formed by a divider with a single input and five output branches in transmission mode, each output branch of a divider in transmission mode including an amplitude and phase control point. Each second analogue former 564*k* of the second set 564 is connected to at least one access column of the first set of first beam formers, an access column being formed by five access terminals to the input channels of the same rank of the first analogue formers 562*i*.

It should be noted that FIGS. 3 to 20 and 23 to 24 are illustrations of embodiments of the invention in which a limited number of radiating elements are represented in the interests of clarity. These embodiments are intended to be applied for numbers of elements greater than those of the illustrations of FIGS. 3 to 20 and 23 and 24. Typically, these embodiments are designed to be applied for active antennas composed of one to several hundreds of radiating elements. They are all the more interesting and advantageous when the number of radiating elements is high.

Figure 25:
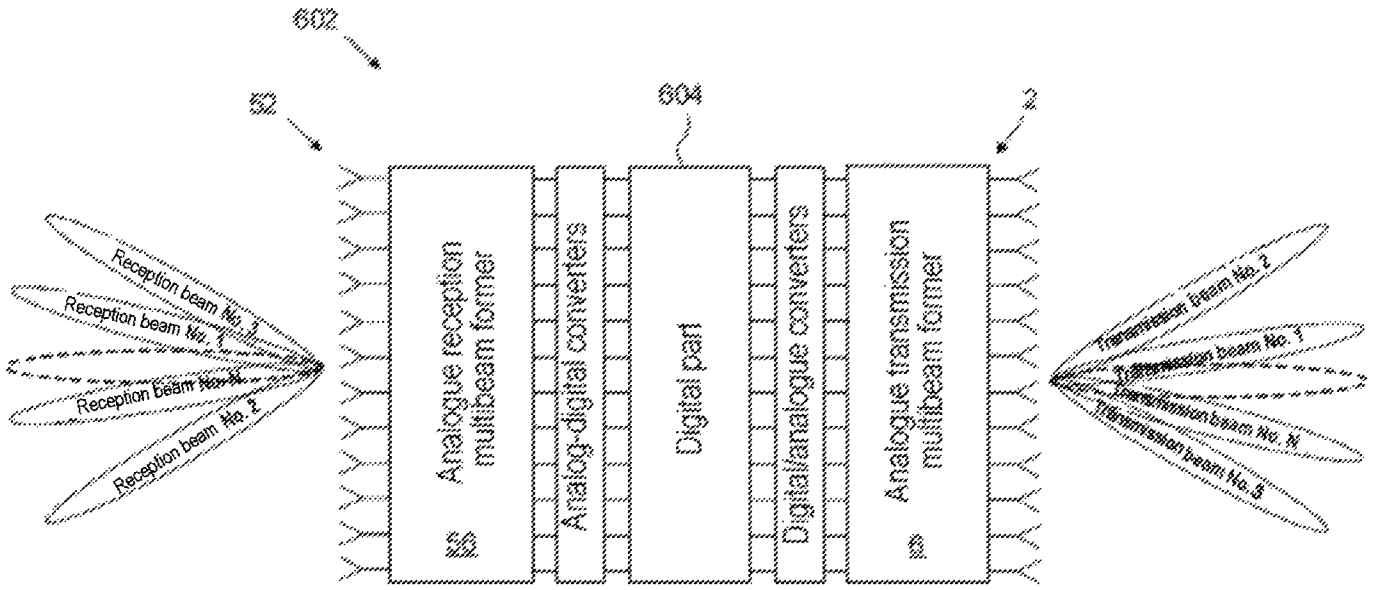
FIG. 25 is a view of an example of a satellite payload incorporating a transmission antenna according to the invention and a reception antenna according to the invention.

The invention applies more particularly to the payloads of satellites incorporating a routing function between the reception antenna or antennas and the transmission antenna or antennas like the payload 602 illustrated in FIG. 25. The aim of this function is to direct some or all of the band of an input beam to one or more output beams. In order to benefit from a significant connection flexibility between the input beams and the output beams and a fine filtering of the frequency bands to be routed, these routers are generally implemented digitally in the digital part of the payload. According to FIG. 25, the router is located in the digital module designated by the numeric reference 606.

Here, two analogue multibeam formers of reconfigurable beams according to the invention as described above are used by the payload. A first analogue multibeam former is configured to generate reception beams and a second analogue multibeam former is configured to generate transmission beams.

As a variant, just one of the two beam formers is an analogue multibeam former according to the invention, the remaining beam former being of another type and using a different architecture.

The invention claimed is:

1. An analogue multibeam former of several two-dimensional radiofrequency beams of continuously variable sizes and/or aiming directions for a reconfigurable two-dimensional active array antenna, having a total integer number M, greater than or equal to 4, of active radiating feeds distributed over a planar or curved surface according to a mesh formed by the points of intersection of a first array of a first integer number R, greater than or equal to 2, of parallel lines along a first axial direction X, and a second array of a second integer number S, greater than or equal to 2, of parallel lines along a second axial direction Y, different from the first axial direction X, and having a set of M RF amplifiers, each active radiating feed being connected directly to an amplifier;

the analogue multibeam former comprising a first set wherein there are superposed R first analogue formers of identical structure and configured to form P fixed radiofrequency beams in first angular aiming directions Ax fixed along the first axial direction X, each first analogue former, i varying from 1 to R, being configured to be connected through S output channels in transmission mode or S input channels in reception mode, each channel including an RF amplifier and corresponding to a row of S active radiating feeds of the antenna array and corresponding to a different line of the mesh of the antenna array, identified by a level index i, i varying from 1 to R; and each first analogue former having an integer number P, greater than or equal to 2, of input channels in transmission mode or output channels in reception mode, numbered by an index of progression j along the first axial direction X;

the analogue multibeam former being comprising a second set of an integer number Q of second analogue formers of radiofrequency beams that are continuously variable in size and/or in aiming direction in second angular aiming directions by along the second axial direction Y, each second analogue former being formed by a divider with a single input and R output branches in transmission mode or by a combiner with a single output and R input branches in reception mode, each output branch of a divider in transmission mode or input branch of a combiner in reception mode including an amplitude and phase control point (118$_{k,i}$, 168$_{k,i}$, 218$_{k,i}$, 268$_{ki}$, 318$_{k,i}$; 368$_{k,i}$); each second analogue former (114*k*; 164*k*; 214*k*; 264*k*; 314*k*; 364*k*) of the second set being connected to at least one access column of the first set of first beam formers, an access column being formed by R access terminals to the input channels of the same rank j of the first analogue formers; and peripheral to the analogue multibeam former and opposite access channels to the radiating feeds of the antenna array, a second switching matrix, according to a second configuration of a predetermined set of routings, for switching the Q inputs in the transmission mode or the Q outputs in the reception mode of the second analogue formers to an integer number T of beam inputs in the transmission mode or of beam outputs in the reception mode, wherein T is greater than or equal to 2 and less than or equal to Q, wherein the number P of input channels in transmission mode or of output channels in reception mode of each first analogue former is strictly greater than the first number R of input channels in transmission mode or of output channels in reception mode of the radiating feeds of one and the same row in the first axial direction; and comprising, for each first analogue former and the associated level, a divider in transmission mode according to a predetermined configuration of division or a combiner in reception mode according to a predetermined configuration of combination, of the outputs in transmission mode or of the inputs in reception mode of the second analogue formers having the associated level of the first analogue former of fixed beams in the first angular direction, the divider in transmission mode or the combiner in reception mode being connected between the outputs in transmission mode or the inputs in reception mode of the second analogue formers having the associated level of said first analogue former of fixed beams in the first angular direction, and the inputs in transmission mode or the outputs in reception mode of the first analogue former.

2. The analogue multibeam former according to claim 1, wherein the first analogue formers (112*i*; 162*i*; 212*i*; 262*i*; 312*i*; 362*i*) are superposed along the second axial direction Y and each correspond to a different row of active radiating feeds along the first axial direction X; and the second analogue formers (114*k*; 164*k*; 214*k*; 264*k*; 314*k*; 364*k*) are aligned side-by-side along the first axial direction X and each correspond to one or more adjacent access columns to the second analogue formers of the second set.

3. The analogue multibeam former according to claim 1, wherein the R superposed first analogue formers of the first set are quasi-optical formers or Butler matrices.

4. The analogue multibeam former according to claim 1, wherein the amplitude and phase control points (118*k,i*) of the R output branches in transmission mode or R input branches in reception mode of each of the Q second analogue formers, aligned side-by-side, of the second set, are analogue electrical components for phase-shifting and amplification or attenuation with phase-shifting and gain that are continuously or quasi-continuously variable as a function of analogue commands or of discrete commands with fine resolution over a wide range.

5. The analogue multibeam former according to claim 1, also comprising, for each first analogue former and the associated level i, i varying from 1 to R, a combiner (172*i*) in transmission mode according to a predetermined configuration of combination or a divider in reception mode according to a predetermined configuration of division, of the outputs in transmission mode or of the inputs in reception mode of the second analogue formers having the associated level i of the first analogue former (112*i*; 162*i*; 212*i*; 262*i*; 312*i*; 362*i*) of fixed beams in the first angular direction.

6. The analogue multibeam former according to claim 1, also comprising, for each first analogue former and the associated level i, i varying from 1 to R, inside the two-dimensional analogue multibeam former, a first switching matrix (220*i*), according to a first configuration of a predetermined set of routings, for switching the outputs in transmission mode or the inputs in reception mode of the second analogue formers (114*k*; 164*k*; 214*k*; 264*k*; 314*k*; 364*k*) having the same associated level i of the first analogue former of fixed beams in the first angular direction X.

7. The analogue multibeam former according to claim 1, also comprising, for each first analogue former and the associated level i, i varying from 1 to R, inside the two-dimensional analogue multibeam former, a first switching matrix (320*i*), according to a first configuration of a predetermined set of routings, for switching the outputs in transmission mode or the inputs in reception mode of the second analogue formers having the associated level of said first analogue former of fixed beams in the first angular direction.

8. The two-dimensional analogue multibeam former according to claim 1, also comprising, for each first analogue former of one-dimensional beams and the associated level i varying from 1 to R, in transmission mode, connected to the inputs of said first analogue former of fixed beams, a divider according to a configuration of division of the outputs of the second analogue beam formers of beams having the associated level i of said first analogue former of fixed beams, or in reception mode, connected to the outputs of said first analogue beam former, a combiner according to a configuration of combination of the inputs of the second analogue beam formers of beams having the associated level j of said first analogue former of fixed beams;

and wherein in transmission mode, the configuration of division is a function of a predetermined pattern of the widths of the transmission beams in the first angular direction Ax; or in reception mode, the configuration of combination is a function of a predetermined pattern of the widths of the reception beams in the first angular direction Ax.

9. The two-dimensional analogue multibeam former according to claim 1, wherein in transmission mode, the amplitude and phase control points of the second formers of beams that are continuously variable in size are adjusted so that the radiation patterns of the transmission beams generated according to predetermined aimings exhibit iso-flux radiation patterns; or in reception mode, the amplitude and phase control points of the second formers of beams that are continuously variable in size are adjusted so that the radiation patterns of the reception beams generated according to predetermined aimings exhibit iso-flux radiation patterns.

10. The two-dimensional analogue multibeam former according to claim 1, wherein the second analogue formers of mobile beams of the second set are integrated in a single circuit of planar form, the integrated circuit being disposed in a plane at right angles to the planes of extension of the circuits of the first analogue formers of fixed beams and abutting endwise with the edges of said circuits that are parallel to one another and contained in one and the same plane.

11. An analogue multibeam former of several two-dimensional radiofrequency beams of continuously variable sizes and/or aiming directions for a reconfigurable two-dimensional active array antenna, having a total integer number M, greater than or equal to 4, of active radiating feeds, forming an antenna array and distributed over a compact and single-piece portion D of a planar or curved surface according to a compact stack of an integer number R, greater than or equal to 2, of rows r(i) that are parallel to one another and oriented in a first local axial direction X, the stack being oriented in a second axial direction Y, different from the first local axial direction X, i designating a level and numbering index from 1 to R in the direction of progression of the second axial direction Y of stacking of said rows r(i), each row r(i), i varying from 1 to R, having an integer number S(i) that is a function of the level i of active radiating feeds, the sum of the integers S(i), i varying from 1 to R, being equal to the number M, and having a set (58) of M RF amplifiers, each active radiating feed being connected directly to an amplifier;

the analogue multibeam former comprising a first set in which there are superposed R first analogue formers of identical structure and configured to form a number P, greater than or equal to 2, of fixed radiofrequency beams in first angular aiming directions Ax fixed along the first local axial direction X, each first analogue former (512*i*), i varying from 1 to R, being configured to be connected through the integer number S(i) of output channels in transmission mode or S(i) input channels in reception mode, each channel including an RF amplifier and corresponding to the row r(i) of the S(i) active radiating feeds of the antenna array; and each first analogue former having P input channels in transmission mode or output channels in reception mode, numbered by an index of progression j along the first axial direction X;

the analogue multibeam former being comprising a second set of an integer number Q of second analogue formers of radiofrequency beams that are continuously variable in size and/or in aiming direction according to second angular aiming directions By along the second axial direction Y, each second analogue former being formed by a divider (516*k*) with a single input and R output branches in transmission mode or by a combiner with a single output and R input branches in reception mode, each output branch of a divider in transmission mode or input branch of a combiner in reception mode including an amplitude and phase control point ($\mathbf{518}_{k,i}$); each second analogue former (514*k*) of the second set being connected to at least one access column of the first set of first beam formers, an access column being formed by R access terminals to the input channels of the same rank of the first analogue formers; and peripheral to the analogue multibeam former and opposite access channels to the radiating feeds of the antenna array, a second switching matrix, according to a second configuration of a predetermined set of routings, for switching the Q inputs in the transmission mode or the Q outputs in the reception mode of the second analogue formers to an integer number T of beam inputs in the transmission mode or of beam outputs in the reception mode, wherein T is greater than or equal to 2 and less than or equal to Q, wherein the number P of input channels in transmission mode or of output channels in reception mode of each first analogue former is strictly greater than the first number R of input channels in transmission mode or of output channels in reception mode of the radiating feeds of one and the same row in the first axial direction; and comprising, for each first analogue former and the associated level, a divider in transmission mode according to a predetermined configuration of division or a combiner in reception mode according to a predetermined configuration of combination, of the outputs in transmission mode or of the inputs in reception mode of the second analogue formers having the associated level of the first analogue former of fixed beams in the first angular direction, the divider in transmission mode or the combiner in reception mode being connected between the outputs in transmission mode or the inputs in reception mode of the second analogue formers having the associated level of said first analogue former of fixed beams in the first angular direction, and the inputs in transmission mode or the outputs in reception mode of the first analogue former.

12. A reconfigurable two-dimensional active transmission antenna for transmitting radiofrequency signals over a plurality of transmission beams of continuously variable sizes and/or aiming directions, comprising an antenna array of active radiating feeds, a set of HP RF power amplifiers, and a two-dimensional analogue multibeam former;

the antenna array of active radiating feeds having a total integer number M, greater than or equal to 4, of active radiating feeds distributed over a planar or curved surface according to a mesh formed by the points of intersection of a first array of a first integer number R, greater than or equal to 2, of parallel lines in a first axial direction X, and of a second array of a second integer number S, greater than or equal to 2, of parallel lines in a second axial direction Y, different from the first axial direction X;

the two-dimensional analogue multibeam former comprising a first set in which there are superposed R first analogue formers of identical structure and configured to form P fixed radiofrequency transmission beams in first angular aiming directions Ax fixed along the first axial direction X, each first analogue former being configured to be connected through S output channels in transmission mode, each channel including an HP RF power amplifier and corresponding to a row of S active radiating feeds of the antenna array and corresponding to a different line of the mesh of the antenna, identified by a level index i, i varying from 1 to R; and each first analogue former having an integer number P, greater than or equal to 2, of input channels in transmission mode, numbered by an index of progression j along the first axial direction X; the two-dimensional active transmission antenna being wherein the two-dimensional analogue multibeam former comprises a second set of an integer number Q of second analogue formers of radiofrequency beams that are continuously variable in size and/or in aiming direction in second angular aiming directions By along the second axial direction Y, each second analogue former being formed by a divider with a single input and R output branches in transmission mode, each output branch of a divider including an amplitude and phase control point; each second analogue former of the second set being connected to at least one access column of the first set of first beam formers, an access column being formed by R access terminals to the input channels of the same rank j of the first analogue formers; and peripheral to the two-dimensional analogue multibeam former and opposite access channels to the radiating feeds of the antenna array, a second switching matrix, according to a second configuration of a predetermined set of routings, for switching the Q inputs in the transmission mode or the Q outputs in a reception mode of the second analogue formers to an integer number T of beam inputs in the transmission mode or of beam outputs in the reception mode, wherein T is greater than or equal to 2 and less than or equal to Q, wherein the number P of input channels in transmission mode of each first analogue former is strictly greater than the first number R of output channels in reception mode of the radiating feeds of one and the same row in the first axial direction; and comprising, for each first analogue former and the associated level, a divider in transmission mode according to a predetermined configuration of division, of the outputs in transmission mode or of the inputs in reception mode of the second analogue formers having the associated level of the first analogue former of fixed beams in the first angular direction, the divider in transmission mode being connected between the outputs in transmission mode or the inputs in reception mode of the second analogue formers having the associated level of said first analogue former of fixed beams in the first angular direction, and the inputs in transmission mode or the outputs in reception mode of the first analogue former.

13. A satellite payload of a telecommunications satellite comprising a multibeam reception antenna, a multibeam transmission antenna, and a router interconnecting the multibeam reception antenna and the multibeam transmission antenna, the multibeam transmission antenna being defined according to claim 12.

14. The satellite payload of a telecommunications satellite according to claim 13, wherein the router is a digital transparent processor (DTP).

15. A reconfigurable two-dimensional active reception antenna for receiving radiofrequency signals over a plurality of reception beams of continuously variable sizes and/or aiming directions, comprising an antenna array of active radiating feeds, a set of low noise RF amplifiers (LNA), and a two-dimensional analogue multibeam former;

the antenna array of active radiating feeds having a total integer number M, greater than or equal to 4, of active radiating feeds distributed over a planar or curved surface according to a mesh formed by the points of intersection of a first array of a first integer number R, greater than or equal to 2, of parallel lines in a first axial direction X, and a second array of a second integer number S, greater than or equal to 2, of parallel lines in a second axial direction Y, different from the first axial direction X;

the two-dimensional analogue multibeam former comprising a first set in which there are superposed S first analogue formers of identical structure and configured to form R fixed radiofrequency beams in first angular aiming directions Ax along the first axial direction X, each first analogue former being configured to be connected through S input channels in reception mode, each channel including a low-noise RF amplifier (LNA), corresponding to a row of S active radiating feeds of the antenna array and corresponding to a different line of the mesh of the antenna, identified by a level index i, i varying from 1 to R; and each first analogue former having an integer number P, greater than or equal to 2, of output channels in reception mode, numbered by an index of progression j along the first axial direction X;

the two-dimensional active transmission antenna being wherein the two-dimensional analogue multibeam former comprises a second set of an integer number Q of second analogue formers of radiofrequency beams that are continuously variable in size and/or in aiming direction in second angular aiming directions By along the second axial direction Y, each second analogue former being formed by a combiner with a single output and R input branches in reception mode, each input branch of a combiner including an amplitude and phase control point; each second analogue former of the second set being connected to at least one access column of the first set, an access column being formed by R access terminals to the output channels of the same rank i of the first analogue formers; and peripheral to the two-dimensional analogue multibeam former and opposite access channels to the radiating feeds of the antenna array, a second switching matrix, according to a second configuration of a predetermined set of routings, for switching the Q inputs in a transmission mode or the Q outputs in the reception mode of the second analogue formers to an integer number T of beam inputs in the transmission mode or of beam outputs in the reception mode, wherein T is greater than or equal to 2 and less than or equal to Q, wherein the number P of output channels in reception mode of each first analogue former is strictly greater than the first number R of input channels in transmission mode or of output channels in reception mode of the radiating feeds of one and the same row in the first axial direction; and comprising, for each first analogue former and the associated level, a combiner in reception mode according to a predetermined configuration of combination, of the outputs in transmission mode or of the inputs in reception mode of the second analogue formers having the associated level of the first analogue former of fixed beams in the first angular direction, the combiner in reception mode being connected between the outputs in transmission mode or the inputs in reception mode of the second analogue formers having the associated level of said first analogue former of fixed beams in the first angular direction, and the inputs in transmission mode or the outputs in reception mode of the first analogue former.

16. A satellite payload of a telecommunications satellite comprising a multibeam reception antenna, a multibeam transmission antenna, and a router interconnecting the multibeam reception antenna and the multibeam transmission antenna, the multibeam reception antenna being defined according to claim 15.

* * * * *